US010317814B2

(12) United States Patent
Takami et al.

(10) Patent No.: US 10,317,814 B2
(45) Date of Patent: Jun. 11, 2019

(54) POWDER SUPPLY DEVICE AND IMAGE FORMING APPARATUS INCORPORATING SAME

(71) Applicant: RICOH COMPANY, Ltd., Ohta-Ku (JP)

(72) Inventors: Nobuo Takami, Kanagawa (JP); Tetsuro Hirota, Kanagawa (JP); Kenji Kikuchi, Kanagawa (JP); Koichi Yamazaki, Kanagawa (JP); Atsushi Nakamoto, Kanagawa (JP); Naohiro Kawashima, Kanagawa (JP); Tatsuya Kubo, Kanagawa (JP); Shinnosuke Koshizuka, Kanagawa (JP); Kazunori Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/370,817

(22) Filed: Dec. 6, 2016

(65) Prior Publication Data

US 2017/0168418 A1 Jun. 15, 2017

(30) Foreign Application Priority Data

Dec. 10, 2015 (JP) ..... 2015-241515

(51) Int. Cl.
*G03G 15/08* (2006.01)

(52) U.S. Cl.
CPC ..... *G03G 15/0856* (2013.01); *G03G 15/0858* (2013.01); *G03G 15/0865* (2013.01); *G03G 15/0889* (2013.01)

(58) Field of Classification Search
None
See application file for complete search history.

(56) References Cited

U.S. PATENT DOCUMENTS 4,159,786 A * 7/1979 Biddle, III ..... G03G 15/0856 101/367
9,523,664 B2 * 12/2016 Hirota ..... G01M 7/02
(Continued)

FOREIGN PATENT DOCUMENTS

JP 2014-174530 9/2014
JP 2016-085291 5/2016

OTHER PUBLICATIONS

JP 2014174530 English machine translation, Fujimori et al., Sep. 22, 2014.*

(Continued)

*Primary Examiner* — Thomas S Giampaolo, II
(74) *Attorney, Agent, or Firm* — XSensus LLP

(57) ABSTRACT

A powder supply device that includes a powder reservoir including a rotator having a rotation shaft, to store powder supplied from a powder container; and a powder amount detector. The powder amount detector includes a detected member disposed in the powder reservoir, a contact member attached to the rotation shaft, to contact the detected member to vibrate or move the detected member, a detector to detect vibration or a displacement of the detected member, and a detection result processor to detect the amount of the powder in the powder reservoir based on detection by the detector. The powder supply device further includes a controller to supply the powder from the powder container to the powder reservoir based on detection by the powder amount detector. The controller rotates the rotator in discharging the powder from the powder reservoir and supplying the powder from the powder container to the powder reservoir.

18 Claims, 22 Drawing Sheets

(56) References Cited

U.S. PATENT DOCUMENTS

| | | | | |
|---|---|---|---|---|
| 9,523,940 | B2 * | 12/2016 | Hosokawa | G03G 15/0858 |
| 9,817,335 | B2 * | 11/2017 | Kawashima | G03G 15/0831 |
| 2011/0222871 | A1 * | 9/2011 | Suzuki | G03G 15/0889 399/27 |
| 2013/0243491 | A1 | 9/2013 | Nodera et al. | |
| 2014/0270818 | A1 | 9/2014 | Tanaka et al. | |
| 2014/0321885 | A1 | 10/2014 | Fujimori et al. | |
| 2015/0023700 | A1 | 1/2015 | Nakamoto et al. | |
| 2016/0116860 | A1 | 4/2016 | Hirota et al. | |
| 2016/0123770 | A1 * | 5/2016 | Feucht | G01D 5/145 324/207.2 |
| 2016/0170328 | A1 | 6/2016 | Hosokawa et al. | |

OTHER PUBLICATIONS

U.S. Appl. No. 15/158,357, filed May 18, 2016.
U.S. Appl. No. 15/177,620, filed Jun. 9, 2016.
U.S. Appl. No. 15/254,229, filed Sep. 1, 2016.
U.S. Appl. No. 15/280,268, filed Sep. 29, 2016.

* cited by examiner

| n | 0 | 1 | 2 | 3 | 4 | 5 | 6 | 7 | 8 | 9 | 10 | 11 | |
|---|---|---|---|---|---|---|---|---|---|---|---|---|---|
| $S_n$ | 3400 | 3390 | 3360 | 3340 | 3310 | 3300 | 3310 | 3320 | 3350 | 3370 | 3380 | 3370 | ··· |
| $S_{n-1} - S_n$ | − | + | + | + | + | + | − | − | − | − | − | + | |

POWDER SUPPLY DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2015-241515, filed on Dec. 10, 2015, in the Japan Patent Office, the entire disclosure of which is hereby incorporated by reference herein.

BACKGROUND

Technical Field

Embodiments of the present invention generally relate to a powder supply device and an image forming apparatus, such as a copier, a printer, a facsimile machine, or a multifunction peripheral or MFP having at least two of copying, printing, facsimile transmission, plotting, and scanning capabilities.

Description of the Related Art

There are developer supply devices including a developer reservoir to temporarily store developer (i.e., powder) to be discharged to a developing device, a developer amount detector to detect the amount of developer in the developer reservoir, and a developer container to contain the developer to be supplied to the developer reservoir. In such developer supply devices, the developer is supplied to the developer reservoir from the developer container based on a detected amount of developer in the developer reservoir.

SUMMARY

An embodiment of the present invention provides a powder supply device that includes a powder reservoir including a rotator having a rotation shaft, to temporarily store powder supplied from a powder container; and a powder amount detector to detect an amount of the powder in the powder reservoir. The powder amount detector includes a detected member disposed in the powder reservoir, a contact member attached to the rotation shaft of the rotator to rotate together with the rotation shaft, to contact the detected member to vibrate or move the detected member, a detector to detect one of vibration and a displacement of the detected member, and a detection result processor to detect the amount of the powder in the powder reservoir based on a detection result generated by the detector. The powder supply device further includes a controller to supply the powder from the powder container to the powder reservoir based on a detection result generated by the powder amount detector. The controller is configured to rotate the rotator in discharging the powder from the powder reservoir to a supply destination and in supplying the powder from the powder container to the powder reservoir.

In another embodiment, an image forming apparatus includes an image bearer, a latent image forming device to form a latent image on the image bearer, a developing device to develop, with developer, the latent image on the image bearer, and a powder supply device to supply the developer to the developing device. The powder supply device includes the powder reservoir and the powder amount detector described above. The image forming apparatus further includes a controller to supply the developer from the powder container to the powder reservoir based on a detection result generated by the powder amount detector. The controller is configured to rotate the rotator in discharging the developer from the powder reservoir to the developing device and in supplying the developer from the powder container to the powder reservoir.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
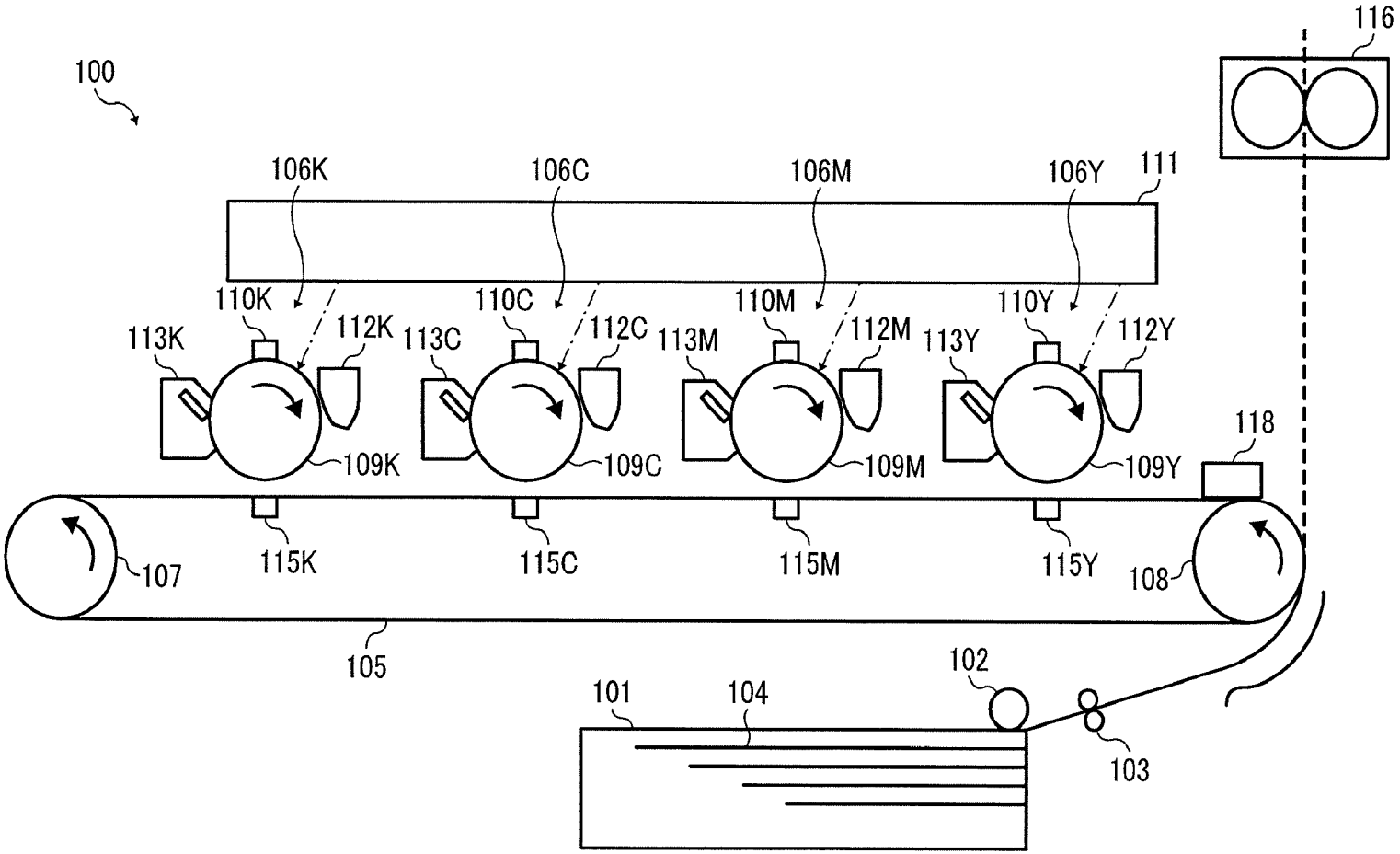
FIG. 1 is a schematic diagram illustrating an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

As an example, descriptions are given below of detection of the amount of developer (i.e., powder) including toner and carrier, in an electrophotographic image forming apparatus. In particular, the present embodiment concerns detection of the amount of developer in a sub-hopper to store developer between a developing device, which develops an electrostatic latent image on a photoconductor, and a container from which the developer is supplied to the developing device. Although the developer in the present embodiment is a mixture of toner and carrier, the powder can be one-component developer (i.e., toner) or another powder. Although the descriptions below concern developer being the powder, one or more of aspects of the present disclosure can adapt to a powder supply device to handle powder such as flour, metal powder, resin powder, and the like.

Referring now to the drawings, wherein like reference numerals designate identical or corresponding parts throughout the several views thereof, and particularly to FIG. 1, an image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring now to the drawings, an embodiment of the present invention is described below.

FIG. 1 is a schematic view of an image forming apparatus 100 according to the present embodiment. As illustrated in FIG. 1, the image forming apparatus 100 employs a so-called tandem system and includes image forming units 106K, 106C, 106M, and 106Y (collectively "image forming units 106") corresponding to different colors, lined along an intermediate transfer belt 105.

The image forming apparatus 100 includes a sheet feeding tray 101 and a sheet feeding roller 102 to feed sheets 104 from the sheet feeding tray 101. A registration roller pair 103 stops the sheet 104 and forwards the sheet 104 to a secondary transfer position where the image is transferred from the intermediate transfer belt 105, timed to coincide with image formation in the image forming units 106. Although the colors of toner images formed thereby are different, the multiple image forming units 106 are similar in internal structure. The image forming unit 106K forms black toner images, the image forming unit 106M forms magenta toner images, the image forming unit 106C forms cyan toner images, and the image forming unit 106Y forms yellow toner images.

The image forming unit 106Y is described in detail below. Since the image forming units 106 have a similar structure, descriptions of the image forming units 106M, 106C, and 106K are omitted. The intermediate transfer belt 105 is an endless belt entrained around a driving roller 107 and a driven roller 108. The driving roller 107, a driving motor to rotate the driving roller 107, and the driven roller 108 together drive the intermediate transfer belt 105.

Among the multiple image forming units 106, the image forming unit 106Y is the first to transfer toner images onto the intermediate transfer belt 105. The image forming unit 106Y includes a photoconductor drum 109Y and components disposed around the photoconductor drum 109Y, namely, a charging device 110Y, a developing device 112Y, a photoconductor cleaner 113Y, and a discharger. The image forming unit 106Y, together with an optical writing device 111, serves as an image forming section. The optical writing device 111 is configured to irradiate, with light, the photoconductor drums 109Y, 109M, 109C, and 109K (collectively "photoconductor drums 109").

To form images, the charging device 110Y uniformly charges the outer face of the photoconductor drum 109Y in the dark, after which the optical writing device 111 directs light from a light source corresponding to yellow images to the photoconductor drum 109Y. Thus, an electrostatic latent image is formed on the photoconductor drum 109Y, and the optical writing device 111 serves as a latent image forming device. The developing device 112Y develops the electrostatic latent image into a visible image with yellow toner. Thus, a yellow toner image is formed on the photoconductor drum 109Y. A transfer device 115Y transfers the toner image onto the intermediate transfer belt 105 at a primary transfer position, where the photoconductor drum 109Y contacts or is closest to the intermediate transfer belt 105. Thus, the yellow toner image is formed on the intermediate transfer belt 105. Subsequently, the photoconductor cleaner 113Y removes toner remaining on the outer face of the photoconductor drum 109Y, and the discharger discharges the outer face of the photoconductor drum 109Y. Then, the photoconductor drum 109Y is on standby for subsequent image formation.

The yellow toner image formed on the intermediate transfer belt 105 by the image forming unit 106Y is then transported to the image forming unit 106M as the intermediate transfer belt 105 rotates. The image forming unit 106M forms a magenta toner image on the photoconductor drum 109M through the processes similar to the processes performed by the image forming unit 106Y. The magenta toner image is transferred from the photoconductor drum 109M and superimposed on the yellow toner image. While rotating, the intermediate transfer belt 105 transports the yellow and magenta toner images further to the image forming units 106C and 106K. Then, cyan and black toner images are transferred from the photoconductor drums 109C and 109K, respectively, and superimposed on the toner image on the intermediate transfer belt 105. Thus, a multicolor (i.e., full-color) intermediate toner image is formed on the intermediate transfer belt 105.

The sheets 104 contained in the sheet feeding tray 101 are sent out from the top sequentially. At a position where a conveyance path of the sheet 104 contacts or is closest to the intermediate transfer belt 105, the intermediate toner image is transferred from the intermediate transfer belt 105 onto the sheet 104. Thus, an image is formed on the sheet 104. The sheet 104 carrying the image is transported to a fixing device 116, where the image is fixed on the sheet 104. Then, the sheet 104 is ejected outside the image forming apparatus 100. The intermediate transfer belt 105 is provided with a belt cleaner 118. The belt cleaner 118 includes a cleaning blade pressed against the intermediate transfer belt 105 to scrape off toner from the surface of the intermediate transfer belt 105 at a position downstream from the secondary transfer position and upstream from the photoconductor drums 109 in the direction in which the intermediate transfer belt 105 rotates.

Figure 2:
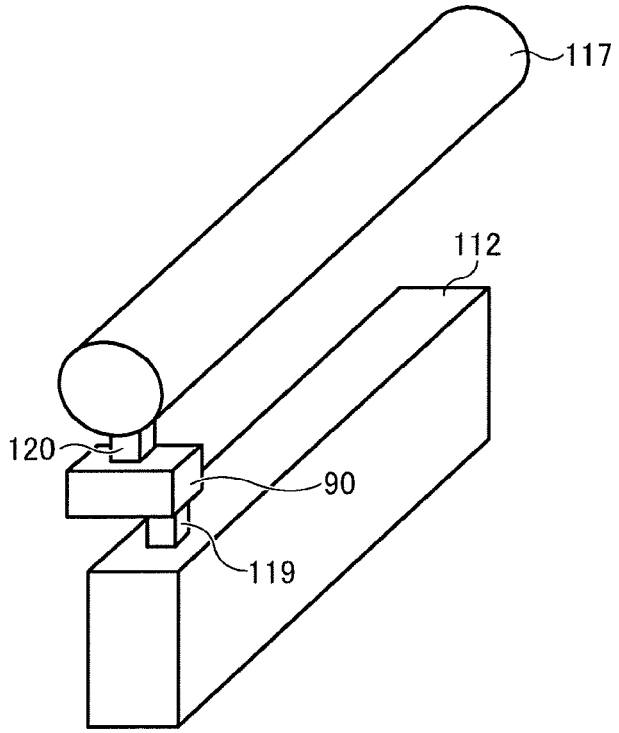
FIG. 2 is a perspective view illustrating a developer supply device according to an embodiment.

Referring to FIG. 2, descriptions are given below of structures for developer supply to the developing devices 112, which are similar among cyan (C), magenta (M), yellow (Y), and black (B). Thus, FIG. 2 illustrates the structure to supply the developer to one of the four developing devices 112. The developer is contained in a developer bottle 117 serving as an upstream powder container. In FIG. 2, a first developer supply passage 119 extends from a sub-hopper 90 to the developing device 112, and a second developer supply passage 120 extends from the developer bottle 117 to the sub-hopper 90. The developer is supplied from the developer bottle 117 through the second developer supply passage 120 to the sub-hopper 90. The sub-hopper 90 temporarily stores the developer supplied from the developer bottle 117 and supplies the developer to the developing device 112 according to the amount of developer remaining in the developing device 112. From the sub-hopper 90, the developer is supplied through the first developer supply passage 119 to the developing device 112. When no or almost no toner remains in the developer bottle 117, developer is not supplied to the sub-hopper 90. An aspect of the present embodiment is to detect a situation in which the amount of developer remaining in the sub-hopper 90 is small.

Next, the driving of respective members for supplying the developer will be described.

Figure 3:
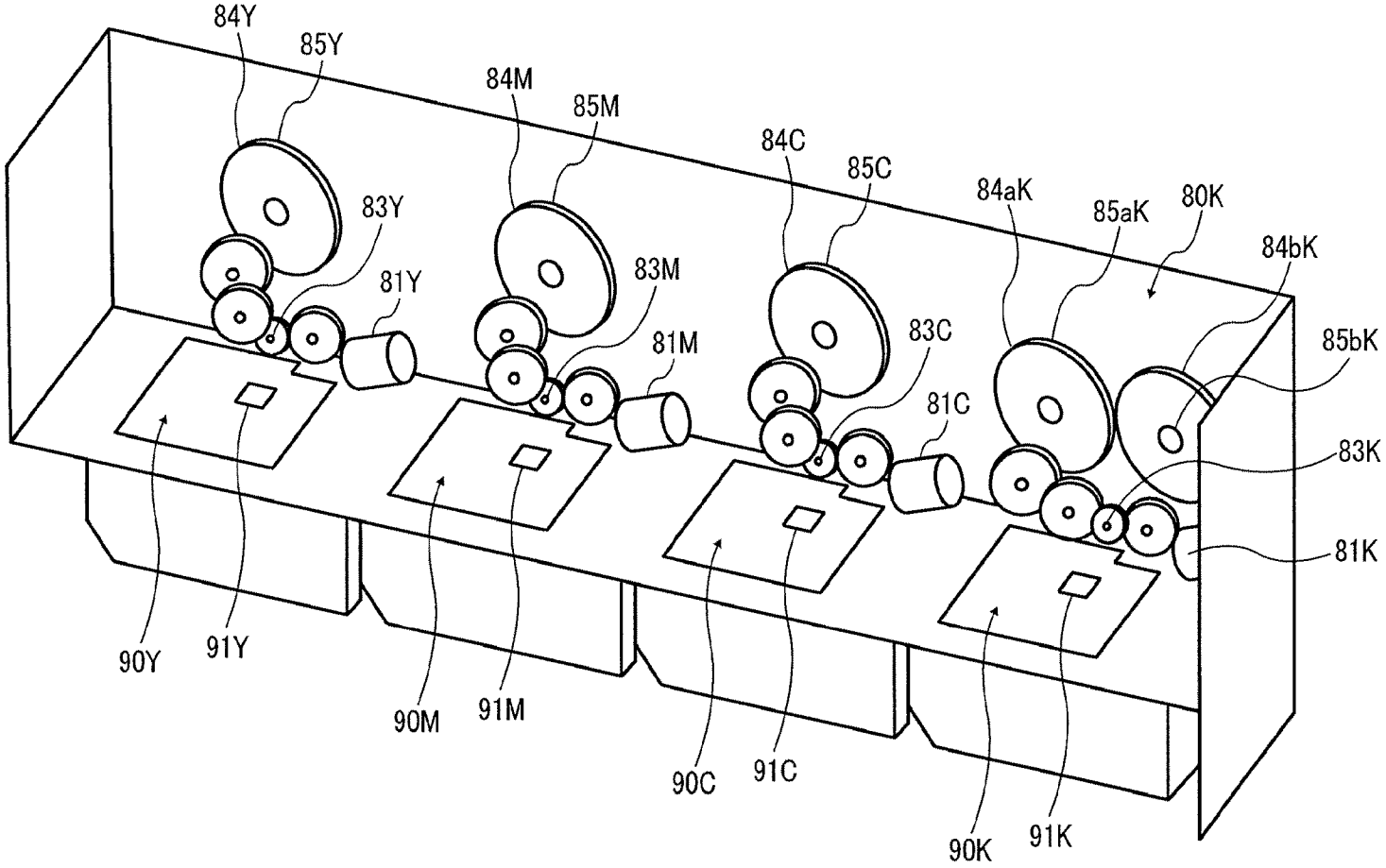
FIG. 3 is a perspective view illustrating developer supply drivers according to an embodiment.
Figure 4:
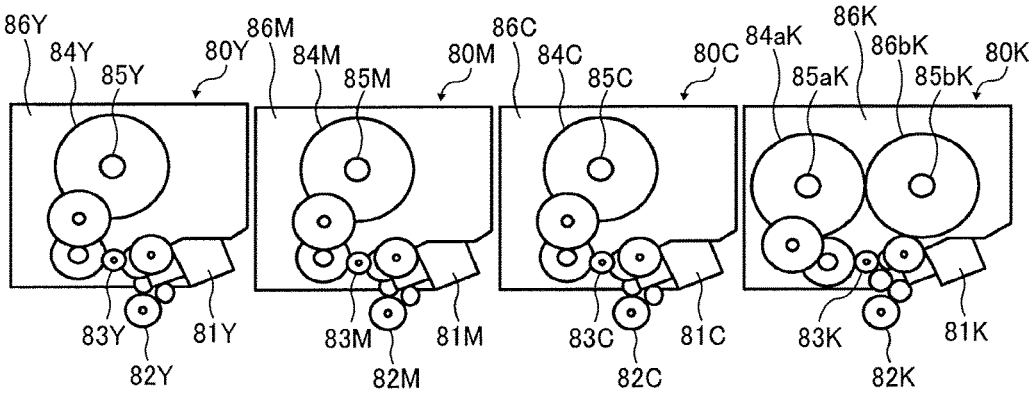
FIG. 4 is a front view of the developer supply drivers illustrated in FIG. 3.

FIG. 3 is a perspective view illustrating developer supply drivers 80Y, 80M, 80C, and 80K, and FIG. 4 is a front view of the developer supply drivers 80Y, 80M, 80C, and 80K.

The developer supply drivers 80Y, 80M, 80C, and 80K serve as supply-use drivers used when the developer within the developer bottles 117 is supplied to the sub-hoppers 90Y, 90M, 90C, and 90K of developer supply devices, respectively. The developer supply drivers 80Y, 80M, 80C, and 80K drive bottle agitators 117A (117A1 and 117A2) and conveying screws 117B of the developer bottles 117 and first and second stirring conveyors 96 and 97 (refer to FIG. 6) within the sub-hoppers 90Y, 90M, 90C, and 90K, which will be described later. The bottle agitators 117A can be screws, coils, paddles, or the like. To supply the developer from the developer bottle 117, at least one of the bottle agitator 117A and the conveying screw 117B disposed inside the developer bottle 117 is driven, thereby causing the developer flowing down from an outlet of the developer bottle 117 into the sub-hopper 90. Alternatively, a conveying screw (or a conveying coil) is provided to convey the developer from the outlet of the developer bottle 117 toward the sub-hopper 90, and the conveying screw is driven to supply the developer from the developer bottle 117 toward the sub-hopper 90.

The developer supply drivers 80Y, 80M, 80C, and 80K include second driving motors 81Y, 81M, 81C, and 81K (supply-use motors), respectively, each of which serves as a second driving source. The developer supply drivers 80Y, 80M, 80C, and 80K are also provided with gear trains each including a plurality of gears. Those gears are supported on plates 86Y, 86M, 86C, and 86K, respectively, so as to freely rotate. In addition, the developer supply drivers 80Y, 80M, 80C, and 80K include conveying-use joints 83Y, 83M, 83C, and 83K, respectively, each of which is coupled to the conveying screw 117B of the developer bottle 117. The developer supply drivers 80Y, 80M, and 80C for colors also include driving-side couplings 85Y, 85M, and 85C, respectively, each of which is coupled to a coupling of the developer bottle 117. Meanwhile, the developer supply driver 80K for black includes a first driving-side coupling 85*a*K coupled to a coupling attached to a shaft of a first bottle agitator 117A1 of the developer bottle 117. The developer supply driver 80K also includes a second driving-side coupling 85*b*K coupled to a coupling attached to a shaft of a second bottle agitator 117A2 of the developer bottle 117.

Driving forces of the respective second driving motors 81Y, 81M, 81C, and 81K are transmitted to the conveying screws 117B of the developer bottles 117 for respective colors via a worm gear, a plurality of gears, and the conveying-use joints 83Y, 83M, 83C, and 83K, thereby the conveying screws are rotated. The driving forces of the respective second driving motors 81Y, 81M, 81C, and 81K are further transmitted to agitator-driving gears 84Y, 84M, and 84C and a first agitator-driving gear 84*a*K from the conveying-use joints 83Y, 83M, 83C, and 83K via a plurality of gears. Subsequently, the driving forces are transmitted to the agitators of the developer bottles 117 via the driving-side couplings 85Y, 85M, and 85C disposed coaxially with the agitator-driving gears 84Y, 84M, and 84C, respectively, thereby driving the agitators. The driving force is also transmitted to the first bottle agitator 117A1 of the developer bottle 117 via the first driving-side coupling 85*a*K disposed coaxially with the first agitator-driving gear 84*a*K, thereby driving the first agitator. In addition, as for the developer supply driver 80K for black, the driving force of the second driving motor 81K is transmitted to a second agitator-driving gear 84*b*K from the first agitator-driving gear 84*a*K. Subsequently, the driving force is transmitted to the second bottle agitator 117A2 of the developer bottle 117 via the second driving-side coupling 85*b*K disposed coaxially with the second agitator-driving gear 84*b*K, thereby driving the second agitator.

The driving forces of the second driving motors 81Y, 81M, 81C, and 81K are also transmitted to second-driving one-way clutches 82Y, 82M, 82C, and 82K, respectively, each of which is attached to an end portion on a rear side of a rotation shaft 96*c* of the first stirring conveyor 96 (refer to FIG. 6) serving as a rotator (stirrer), which will be described later. Subsequently, the driving forces of the respective second driving motors 81Y, 81M, 81C, and 81K are transmitted to the first stirring conveyor 96 and the second stirring conveyors 97 described later via the second-driving one-way clutches 82Y, 82M, 82C, and 82K.

Next, the sub-hoppers 90Y, 90M, 90C, and 90K will be described. Note that, because the sub-hoppers 90Y, 90M, 90C, and 90K of respective colors are similar in structure and operation, the sub-hopper for black will be described here and subscripts, namely, Y, M, C, and K will be omitted as appropriate in the following description.

Figure 5:
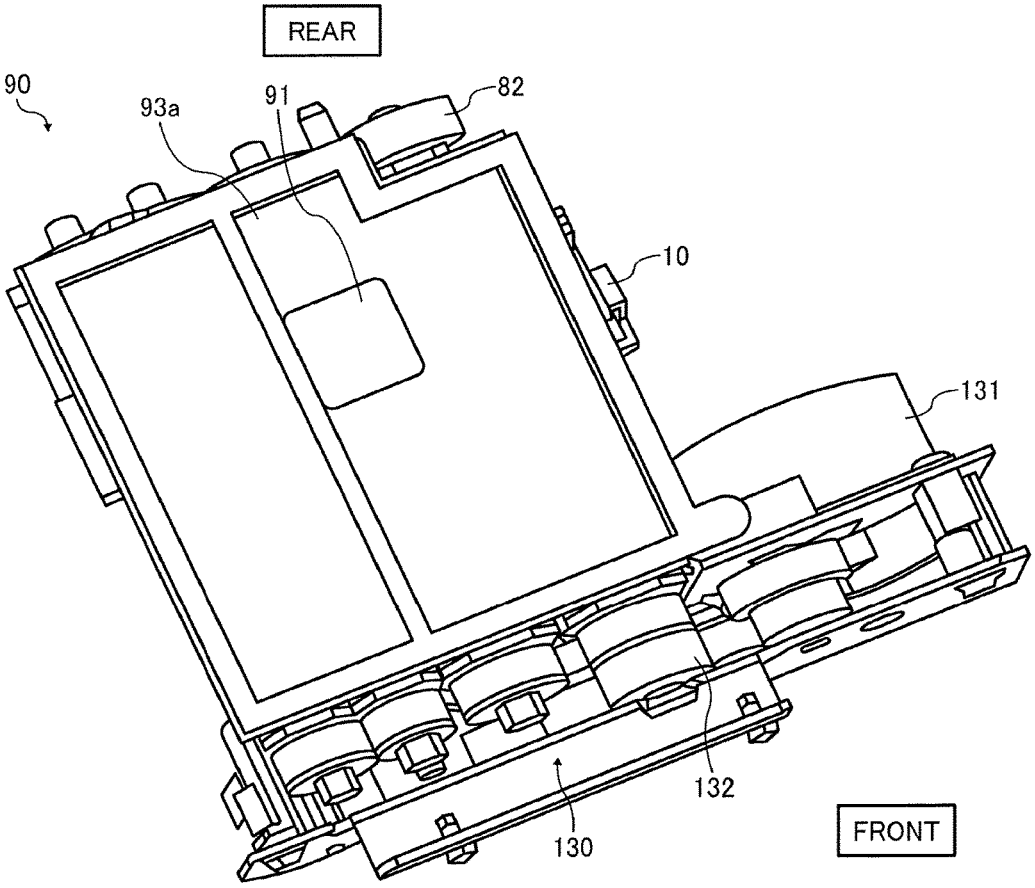
FIG. 5 is a perspective view of a sub-hopper of the developer supply device illustrated in FIG. 2.
Figure 6:
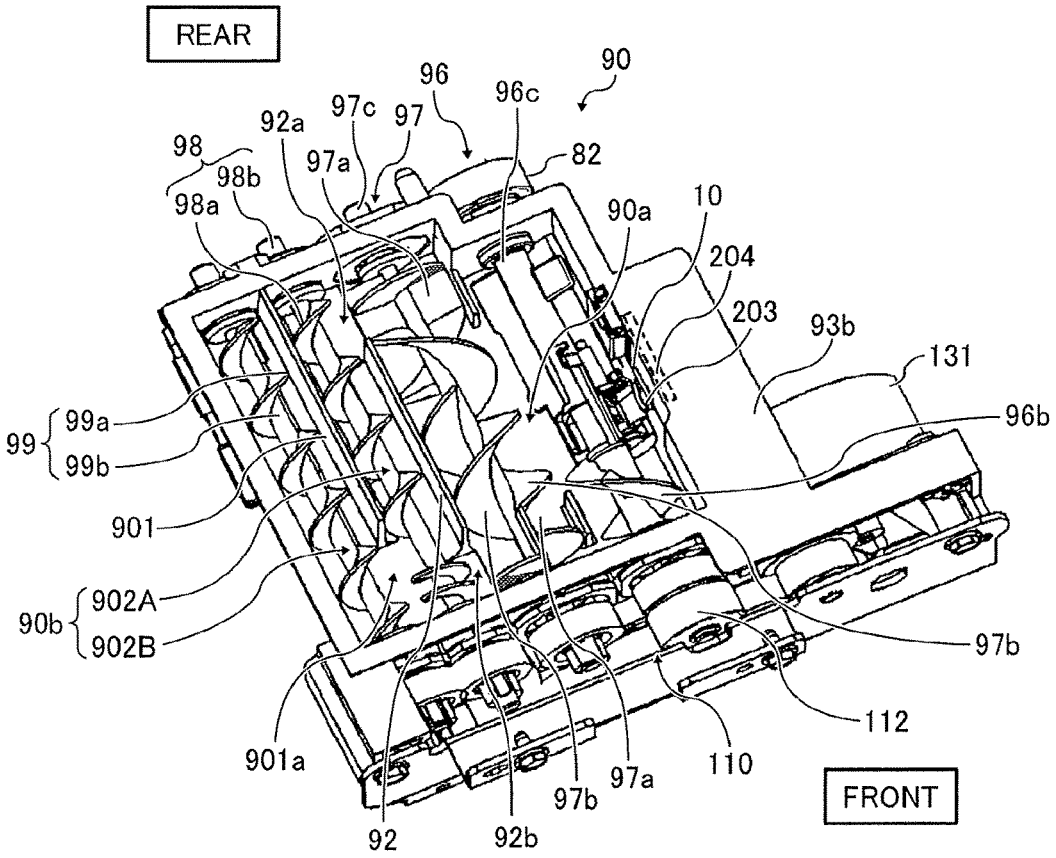
FIG. 6 is a perspective view of the sub-hopper, in which an upper side is open to illustrate an interior thereof.

FIG. 5 is a perspective view of the sub-hopper 90. FIG. 6 is a perspective view illustrating an interior of the sub-hopper 90. The upper side of the sub-hopper 90 is open in FIG. 6.

As illustrated in FIGS. 5 and 6, the sub-hopper 90 includes a case 93*b*, which contains a first stirring conveyor 96, a second stirring conveyor 97, a first conveyor 98, and a second conveyor 99 and is open on the upper side. The sub-hopper 90 further includes an upper cover 93*a* as a lid of the case 93*b*. The upper cover 93*a* includes an inlet 91 to receive the developer supplied from a supply opening of the developer bottle 117.

The sub-hopper 90 includes, inside the case 93*b*, a developer reservoir 90*a* (i.e., a downstream powder container or a powder reservoir) to temporarily store the developer supplied from the developer bottle 117 and a conveyance compartment 90*b* to transport the stored developer to the developing device 112. The developer reservoir 90*a* is separated from the conveyance compartment 90*b* by a partition 92. First and second openings 92*a* and 92*b* are secured at both ends of the partition 92. The first opening 92*a* is on the rear side (upper side in the drawing or a driving unit side), and the second opening 92*b* is on the front side (lower side in the drawing).

The first stirring conveyor 96 and the second stirring conveyor 97 are disposed side by side in the developer reservoir 90*a*. On the right wall (in FIG. 6) of the case 93*b* of the sub-hopper 90, a magnetic flux sensor 10 serving as a vibration detector is disposed. On the inner face of the right wall (in FIG. 6) of the case 93*b*, a vibration plate 201 (a detected member) is disposed to face the magnetic flux sensor 10 via the case 93*b*. The first stirring conveyor 96, which is disposed on the right side, in the drawing, of the developer reservoir 90*a*, includes a rotation shaft 96*c* and a spiral screw blade 96*b* whose pitch is relatively large. Additionally, a torsion spring 203, serving as a contact member (to vibrate the vibration plate 201), to flip the vibration plate 201 is disposed on the first stirring conveyor 96. The second stirring conveyor 97, which is on the side of the partition 92 in the developer reservoir 90*a*, includes a rotation shaft 97*c*, a spiral blade 97*b* whose pitch is relatively large, and paddles 97*a*. The paddles 97*a* are disposed on the rotation shaft 97*c* and positioned to face the first opening 92*a* and the second opening 92*b*, respectively.

The conveyance compartment 90*b* is partitioned by a partition 901 into a first passage 902A and a second passage 902B. An opening 901*a* for conveyance is disposed on the front side of the partition 901 so that the first passage 902A and the second passage 902B communicate with each other. The first conveyor 98 is disposed in the first passage 902A, and the second conveyor 99 is disposed in the second passage 902B. The first conveyor 98 has a rotation shaft 98*b* and a spiral blade 98*a*. The second conveyor 99 has a rotation shaft 99*b* and a spiral blade 99*a*. The pitch of the spiral blade 98*a* of the first conveyor 98 is reduced in a range facing the opening 901*a*.

The pitch of the spiral blade 99*a* of the second conveyor 99 is uniform in the axial direction thereof. The first conveyor 98 transports the developer in the first passage 902A toward the opening 901*a* (from the rear side to the front side). The second conveyor 99 transports the developer in the second passage 902B from the front side to the rear side. The downstream end of the second passage 902B communicates with a developer outlet formed in the bottom of the case 93*b*. The developer outlet communicates with a supply inlet of the developing device 112. The developer transported through the second passage 902B by the second conveyor 99 is supplied through the developer outlet to the developing device 112.

The sub-hopper 90 is provided with a driving part 130 (illustrated in FIG. 5, serving as a replenishment-use driver) to replenish the developing device 112 with the developer supplied from the sub-hopper 90. The driving part 130 is disposed on the front side of the sub-hopper 90 and includes a first driving motor 131 (i.e., a first driving source or replenishment-use motor) and a gear train including multiple gears. The driving force of the first driving motor 131 is transmitted, via a one-way clutch 132 (disposed at a lower end in the drawing of the rotation shaft 96*c* of the first stirring conveyor 96), to the first stirring conveyor 96. Then, the first stirring conveyor 96 rotates. The driving force of the first driving motor 131 is transmitted further from the first stirring conveyor 96 via the multiple gears to the second stirring conveyor 97. Then, the second stirring conveyor 97 rotates. Additionally, the driving force of the first driving motor 131 is transmitted via the multiple gears to the first and second conveyors 98 and 99. Then, the first and second conveyors 98 and 99 rotate.

In the present embodiment, the developer reservoir 90*a* stores the developer. Even when the developer bottle 117 becomes empty, the developer can be supplied from the developer reservoir 90*a* to the developing device 112. With this structure, preferable images can be produced while uses are preparing a new developer bottle 117.

Figure 7:
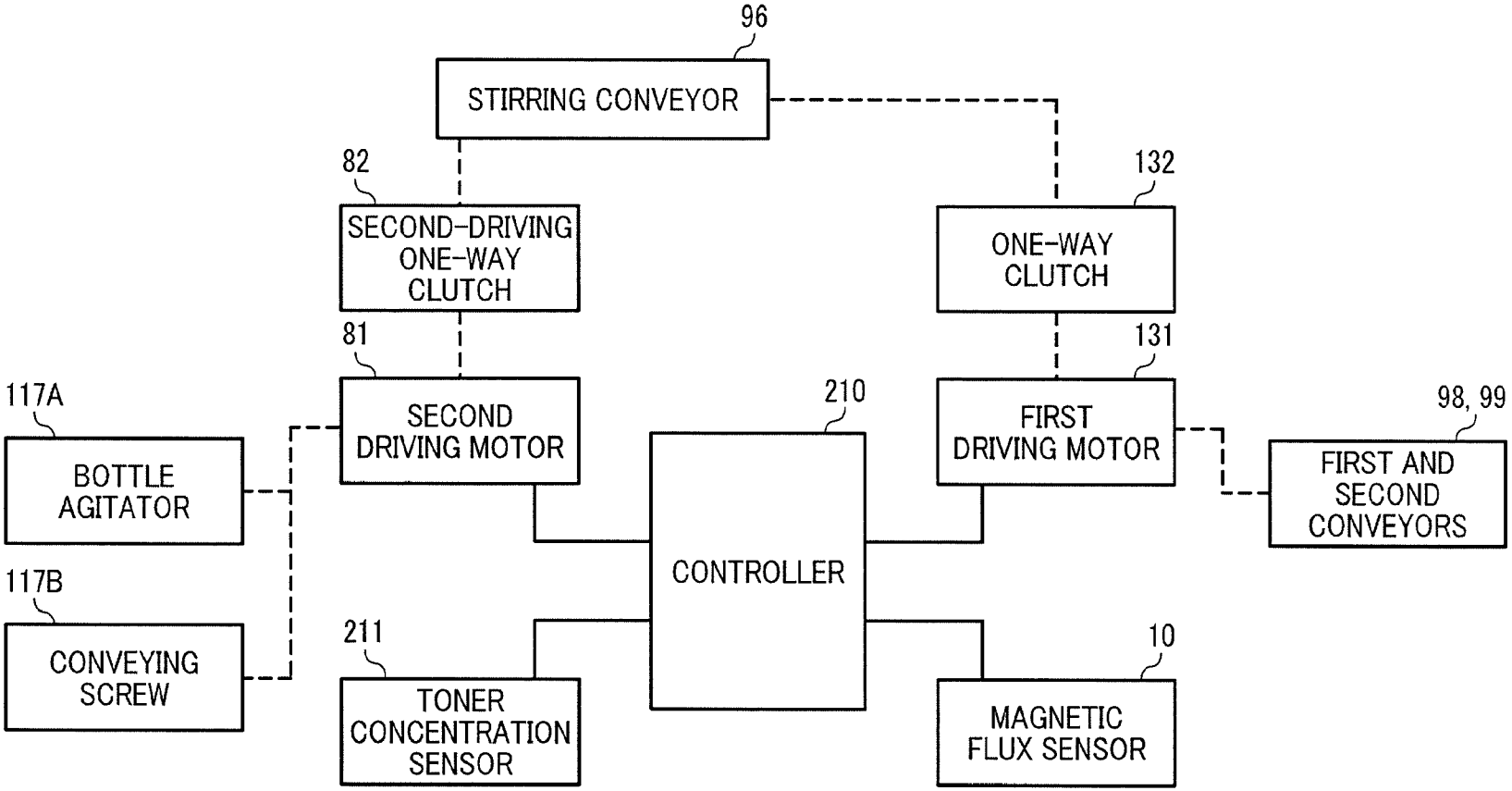
FIG. 7 is a block diagram illustrating an exemplary configuration of principal portions of control circuitry of in the developer supply device according to an embodiment.

FIG. 7 is a block diagram illustrating an exemplary configuration of principal portions of control circuitry of the developer supply device.

In FIG. 7, a controller 210 includes a central processing unit (CPU), a read only memory (ROM) storing a control program or various types of data, a random access memory (RAM) temporarily storing various types of data, and so on. The controller 210 receives a detection result on the toner concentration from a toner concentration sensor 211 that detects the toner concentration in developer contained in the developing device 112. The controller 210 compares a target value stored in the RAM and the detection result from the toner concentration sensor 211 and controls a first driving motor 131 to supply, to the developing device 112, developer in accordance with the comparison result. In specific terms, the first driving motor 131 is driven for a time period corresponding to the amount to be supplied. Then, the developer is supplied from the developer supply device to the developer in which the toner concentration has decreased due to toner consumption during image development. For example, the supplied developer has a toner content of 25 to 35 percent by weight, which is larger than the content of toner in the developer in the developing device 112 (e.g., 4 to 10 percent by weight). Accordingly, when the developer is supplied into the developing device 112, the toner concentration in developer in the developing device 112 increases and thus, the toner concentration in developer in the developing device 112 is kept near the target value.

The developer supply device can include the controller 210. Alternatively, the image forming apparatus 100 can include the controller 210.

In addition, in response to a signal from the magnetic flux sensor 10 indicating that the amount of the developer in a developer reservoir 90*a* is less than a predetermined amount (i.e., "no developer"), the controller 210 drives the second driving motor 81 to supply the developer. The magnetic flux sensor 10 functions as a vibration detector of a powder amount detector, and details of a detection principle thereof will be described later. Subsequently, in response to a signal from the magnetic flux sensor 10 indicating that the amount of the developer in the developer reservoir 90*a* is equal to or greater than the predetermined amount, the controller 210 stops driving the second driving motor 81 to end the supply of the developer. Meanwhile, when the signal from the magnetic flux sensor 10 does not change even after the second driving motor 81 is driven for a predetermined time period (12 seconds in the present embodiment), the controller 210 stops driving the second driving motor 81. Subsequently, deeming that the developer bottle 117 has no developer, the controller 210 causes a display of the image forming apparatus 100 to display a message prompting the replacement of the developer bottle 117.

Next, the movement of the developer in the sub-hopper 90 will be described.

Figure 8:
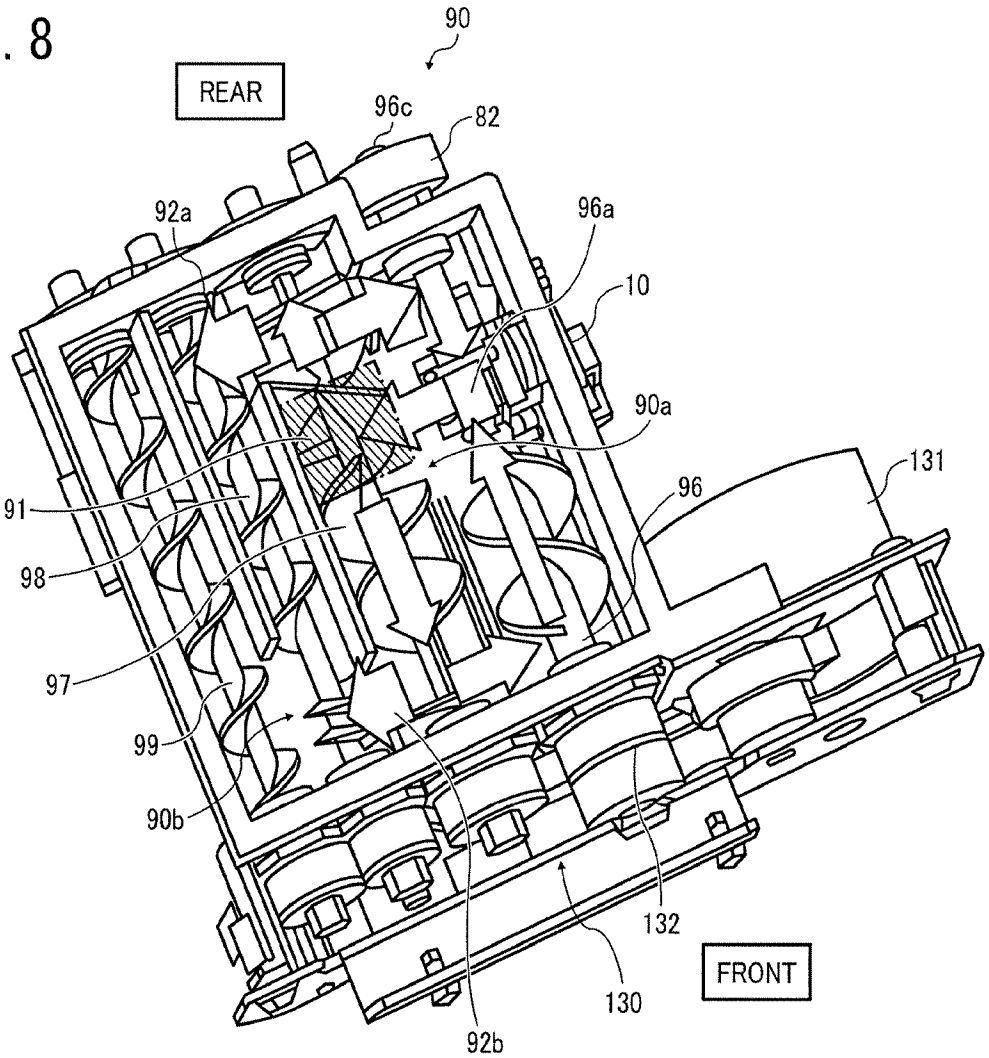
FIG. 8 is an explanatory view for explaining the movement of the developer when the developer is supplied to a developer reservoir of the sub-hopper from a developer bottle of the developer supply device illustrated in FIG. 2.

FIG. 8 is a view for explaining the movement of the developer when the developer is supplied to the developer reservoir 90*a* from the developer bottle 117.

As illustrated in FIG. 8, while the developer is supplied to the developer reservoir 90*a* from the developer bottle 117, as described earlier, the second driving motor 81 is driven. Once the second driving motor 81 is driven, the first stirring conveyor 96 and the second stirring conveyor 97 are rotated via the second-driving one-way clutch 82. At this time, the rotation shaft 96*c* of the first stirring conveyor 96 rotates idle with respect to a first-driving one-way clutch 132 and thus, the first-driving one-way clutch 132 does not rotate. The first and second stirring conveyors 96 and 97 rotate clockwise in the drawing when viewed from a front side.

The developer in the developer bottle 117 is supplied onto the second stirring conveyor 97 of the developer reservoir 90*a*. The developer supplied to the second stirring conveyor 97 is conveyed to the front side and the rear side by the second stirring conveyor 97. The developer conveyed to the end portion on the rear side by the second stirring conveyor 97 passes through the first opening 92*a* to the conveyance compartment 90*b*. At this time, since the conveyors 98 and 99 of the conveyance compartment 90*b* are not rotating, the developer is accumulated in the vicinity of the first opening 92*a* of the conveyance compartment 90*b*. When the developer is blocked from being conveyed to the conveyance compartment 90*b* due to this accumulated developer, the developer conveyed to the end portion on the rear side is conveyed to the first stirring conveyor 96. The developer conveyed to the end portion on the front side by the second stirring conveyor 97 passes through the second opening 92*b* to the conveyance compartment 90*b*. Subsequently, when the developer is blocked from being conveyed to the conveyance compartment 90*b* due to the developer accumulated in the vicinity of the second opening 92*b* of the conveyance compartment 90*b*, the developer conveyed to the end portion on the front side is also conveyed to the side of the first stirring conveyor 96.

As illustrated in FIG. 8, the first stirring conveyor 96 conveys the developer toward a region where a vibration plate is disposed, which serves as a detected member whose vibration is detected by the magnetic flux sensor 10. The developer conveyed to the region where the vibration plate 201 is disposed is conveyed vertically below the inlet 91 by a paddle-shaped cleaner 96*a*. While the developer is thus supplied to the developer reservoir 90*a* from the developer bottle 117, the developer is circulated in the developer reservoir 90*a* by the first and second stirring conveyors 96 and 97.

Figure 9:
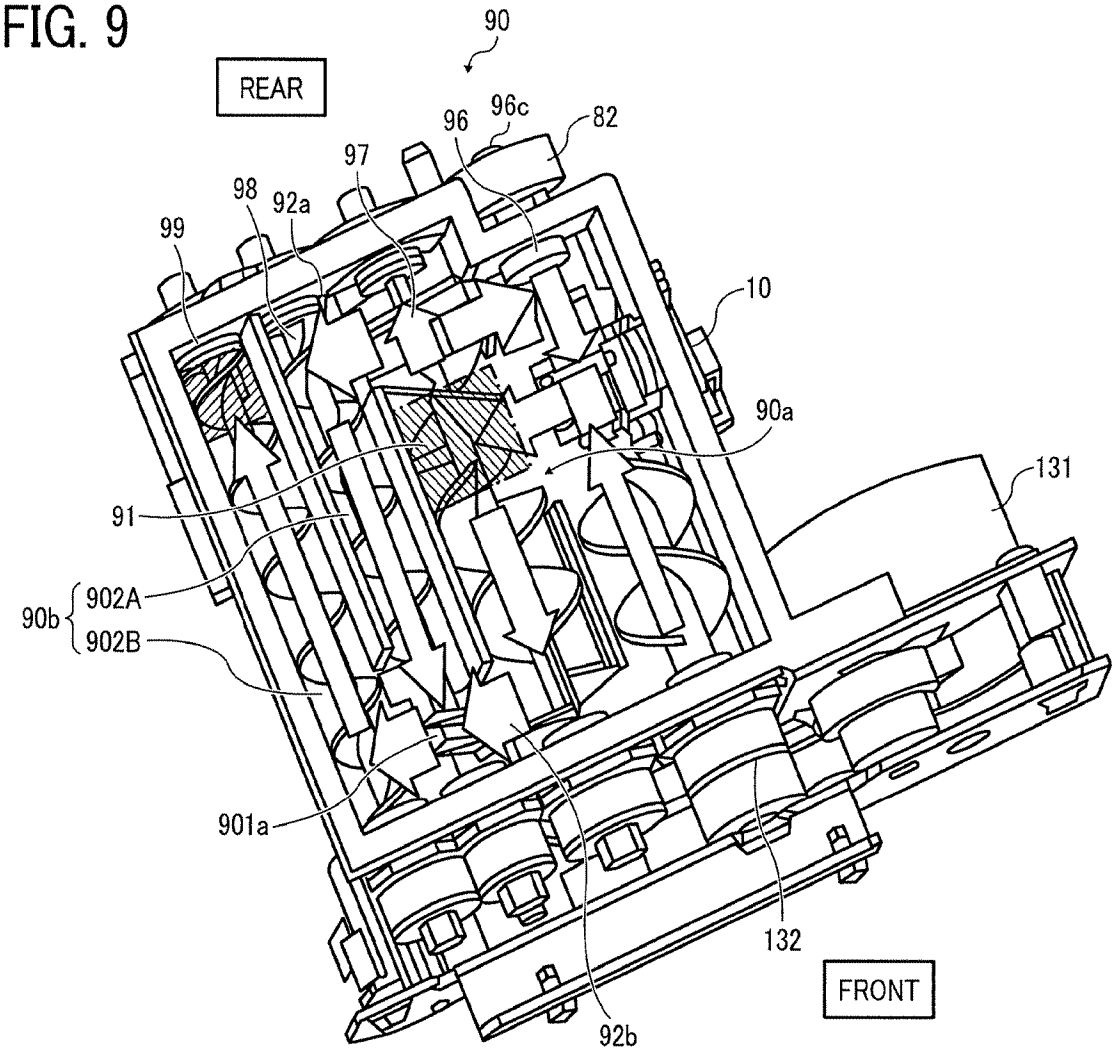
FIG. 9 is an explanatory view for explaining the movement of the developer when the developer is supplied to a developing device according to an embodiment.

FIG. 9 is a view for explaining the movement of the developer when the developer is supplied to the developing device 112.

While the developer is supplied to the developing device 112, the first driving motor 131 is driven. As the first driving motor 131 drives, the first and second stirring conveyors 96 and 97 and the first and second conveyors 98 and 99 rotate. In the present embodiment, the first and second stirring conveyors 96 and 97 and the first conveyor 98 rotate clockwise when viewed from the front side of the apparatus, whereas the second conveyor 99 rotates counterclockwise when viewed from the front side. The developer in the first passage 902A is conveyed to the front side from the rear side by the first conveyor 98. Subsequently, the first conveyor 98 forwards the developer from the end portion on the front side through the opening 901*a* to the second passage 902B. In the second passage 902B, the second conveyor 99 conveys the developer to the rear side from the front side. At the rear end, the developer drops through the supply inlet to the developing device 112.

Meanwhile, the developer in the developer reservoir 90*a* is conveyed similarly to the above description. During the supply of developer, however, the first conveyor 98 and the second conveyor 99 are rotated, and the developer is not accumulated in the vicinity of the first and second openings 92*a* and 92*b* of the conveyance compartment 90*b* but is conveyed further. Accordingly, the developer in the developer reservoir 90*a* is not circulated in the developer reservoir 90*a* but is sequentially forwarded to the conveyance compartment 90*b*.

As the developer in the developer reservoir 90*a* is sequentially forwarded through the first and second openings 92*a* and 92*b* to the conveyance compartment 90*b* as described above, the amount of the developer in the developer reservoir 90*a* decreases gradually. As a result, the height of the developer becomes lower than the region where the vibration plate 201, the vibration of which is detected by the magnetic flux sensor 10, is disposed. Consequently, the vibration of the vibration plate 201 no longer changes due to the developer. At this point, as will be described later, the controller 210 detects that there is no developer in the developer reservoir 90*a* based on the output value from the magnetic flux sensor 10 detecting the vibration of the vibration plate 201. Then, the second driving motor 81 is driven to start supplying the developer to the developer reservoir 90*a*. Once the second driving motor 81 is driven, the driving force is transmitted to the second-driving one-way clutch 82. Thus, the second-driving one-way clutch 82 is rotated. In the present embodiment, the rotation speed of the second-driving one-way clutch 82 is set faster than the rotation speed of the first stirring conveyor 96 rotated by the first driving motor 131. Before the second-driving one-way clutch 82 is caused to rotate, the rotation shaft 96*c* of the first stirring conveyor 96 rotates clockwise, relative to the second-driving one-way clutch 82, as viewed from the front side of the apparatus, in the present embodiment. By contrast, when the second-driving one-way clutch 82 rotates, the rotation shaft 96*c* of the first stirring conveyor 96 rotates counterclockwise, relative to the second-driving one-way clutch 82, as viewed from the front side. As a result, the second-driving one-way clutch 82 is coupled. Accordingly, the first and second stirring conveyors 96 and 97 are rotated by the driving force of the second driving motor 81. As the first stirring conveyor 96 starts rotating, due to the driving force of the second driving motor 81, the rotation speed of the rotation shaft 96*c* of the first stirring conveyor 96 becomes faster than the rotation speed of the first-driving one-way clutch 132. With this configuration, the rotation shaft 96*c* of the first stirring conveyor 96 rotates idle with respect to the first-driving one-way clutch 132. In addition, the first and second conveyors 98 and 99 are continuously driven to rotate by the first driving motor 131.

Thus, by setting the rotation speed of the first stirring conveyor 96 rotated by the second driving motor 81 to a speed different from the rotation speed of the first stirring conveyor 96 rotated by the first driving motor 131, driving sources can be switched to each other with inexpensive one-way clutches. In a configuration in which the driving sources are switched using an electromagnetic clutch or the like, it is necessary to control a timing for coupling the clutch. By contrast, the present embodiment dispenses with controlling such a timing to couple the clutch or the like and is advantageous in that software configuration can be simplified.

Next, descriptions are given below of an internal structure of the magnetic flux sensor 10 according to the present embodiment with reference to FIG. 10. The magnetic flux sensor 10 is an oscillator circuit based on a Colpitts-type LC oscillator circuit (L represents a inductor and C represents a capacitor) and includes a coil pattern 11, a resistor pattern 12, first and second capacitors 13 and 14, a feedback resistor 15, unbuffered integrated circuits (ICs) 16 and 17, and an output terminal 18.

The coil pattern 11 is a planar coil made from conducting wire (signal wire) printed on a board 300 (illustrated in FIG. 12) of the magnetic flux sensor 10. As illustrated in FIG. 10, the coil pattern 11 has an inductance L attained by the coil. In the coil pattern 11, the inductance L changes depending on the magnetic flux passing through a space opposing a board face on which the coil pattern 11 is printed. The magnetic flux sensor 10 in the present embodiment is used as a signal generator to output signals having a frequency corresponding to the magnetic flux passing through the space opposed to the face bearing the coil pattern 11.

Similar to the coil pattern 11, the resistor pattern 12 is a planar resistor made of a planar pattern of a conducting wire printed on the board 300. The resistor pattern 12 in the present embodiment has a serpentine or zigzag pattern, thereby better inhibiting flow of electrical current compared with a resistor having a linear pattern. Incorporating the resistor pattern 12 is one aspect of the present embodiment. The term "zigzag" means the shape in which the wire is bent and folded back, like a serpentine, multiple times to reciprocate in a predetermined direction. Referring to FIG. 10, the resistor pattern 12 has a resistance value $R_p$. The coil pattern 11 and the resistor pattern 12 are connected in series with each other.

The first and second capacitors 13 and 14 serve as a capacitance and a part of the Colpitts-type LC oscillator circuit including the coil pattern 11. Accordingly, the first and second capacitors 13 and 14 are connected serially with the coil pattern 11 and the resistor pattern 12. A loop including the coil pattern 11, the resistor pattern 12, and the first and second capacitors 13 and 14 serves as a resonance current loop.

The feedback resistor 15 is inserted to stabilize a bias voltage. With a function of the unbuffered ICs 16 and 17, fluctuations in potential of a part of the resonance current loop are output as a rectangular wave corresponding to the resonance frequency from the output terminal 18.

With this configuration, the magnetic flux sensor 10 oscillates at a frequency f corresponding to the inductance L, the resistance value $R_P$, and a capacitance C of the first and second capacitors 13 and 14. The frequency f is expressed by Formula 1 below.

$$f = \frac{1}{2\pi}\sqrt{\frac{1}{LC} - \left(\frac{R_L + R_P}{2L}\right)^2} \qquad \text{Formula 1}$$

The inductance L changes depending on the presence and density of the magnetic material adjacent to the coil pattern 11 (planar coil). Thus, according to the oscillation frequency of the magnetic flux sensor 10, the magnetic permeability in the space adjacent to the coil pattern 11 can be determined.

Figure 10:
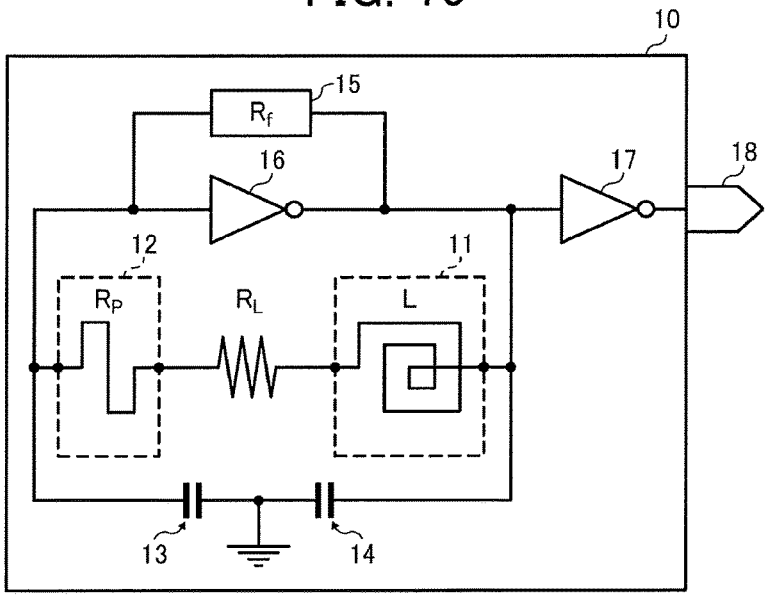
FIG. 10 illustrates circuitry of a magnetic flux sensor according to an embodiment.

It is to be noted that a circuit resistance $R_L$ (resistance value) is caused by a conducting wire or signal wire (e.g., the length of the wire) forming the circuit illustrated in FIG. 10. Most of the conducting wire is used to form the coil pattern 11 in the magnetic flux sensor 10 according to the present embodiment. Accordingly, the circuit resistance $R_L$ is substantially identical to the resistance value attained by the conducting wire forming the coil pattern 11.

As described above, the magnetic flux sensor 10 faces the vibration plate 201 via the case 93*b* of the sub-hopper 90 in the present embodiment. Accordingly, the magnetic flux generated by the coil pattern 11 passes through the vibration plate 201. That is, the vibration plate 201 affects the magnetic flux generated by the coil pattern 11 and affects the inductance L. Consequently, the vibration plate 201 affects the frequency of signal of the magnetic flux sensor 10.

Figure 11:
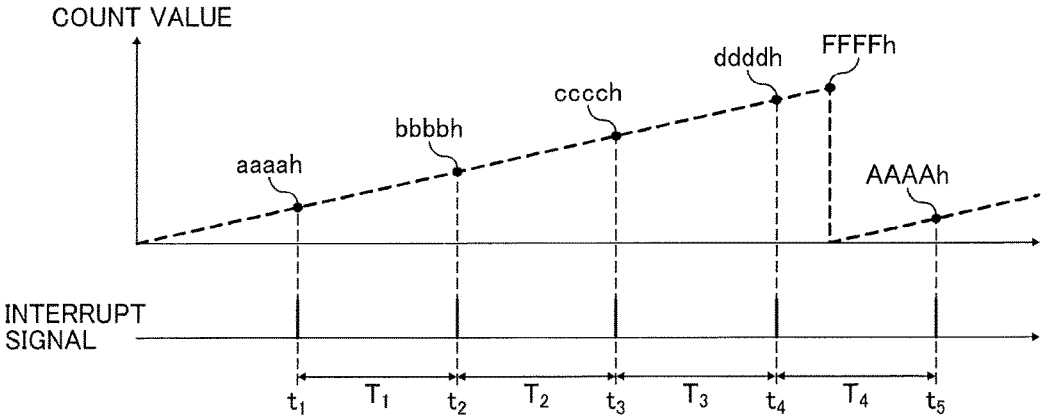
FIG. 11 is a chart of counting of a signal output from the magnetic flux sensor.

FIG. 11 is a chart of counting of signal output from the magnetic flux sensor 10 according to the present embodiment. If the magnetic flux generated by the coil pattern 11 does not change, the magnetic flux sensor 10 keeps oscillating at a constant frequency basically. Consequently, the count value of the output signal increases constantly with elapse of time as illustrated in FIG. 11. For example, in FIG. 11, at time points $t_1$, $t_2$, $t_3$, $t_4$, and $t_5$, count values aaaah, bbbbh, cccch, ddddh, and AAAAh are acquired respectively.

The count values are calculated based on Periods $T_1$, $T_2$, $T_3$, and $T_4$ . . . , respectively, to obtain the frequency in each of Periods $T_1$, $T_2$, $T_3$, and $T_4$ in FIG. 11. For example, in a case where an interrupt signal is output each time a reference clock equivalent for 2 milliseconds (ms) is counted, the count value in each period is divided with 2 ms. Thus, the frequency f (Hz) of the magnetic flux sensor 10 in each of Periods $T_1$, $T_2$, $T_3$, and $T_4$ in FIG. 11 is calculated. In the case where the upper limit of the count value is FFFFh as in FIG. 11, the oscillation frequency f (Hz) in Period $T_4$ can be calculated as follows. Deduct ddddh from FFFFh and divide, with 2 ms, the sum of the AAAAh and FFFFh—ddddh.

Thus, the image forming apparatus 100 according to the present embodiment acquires the frequency of signal generated by the magnetic flux sensor 10 and determines, based on the result of acquisition, a phenomenon corresponding to the oscillation frequency of the magnetic flux sensor 10. In the magnetic flux sensor 10 according to the present embodiment, the inductance L changes in response to the state of the vibration plate 201 disposed facing the coil pattern 11, and the frequency of signal output from the output terminal 18 changes accordingly. Consequently, the controller 210 to acquire the signal recognizes the state of the vibration plate 201 disposed facing the coil pattern 11. The controller 210 determines the state of developer inside the sub-hopper 90 based on the state of the vibration plate 201. It is to be noted that, although the frequency is obtained by dividing the count value of the signal by the period in the description above, alternatively, in a case where the period during which the count value is acquired is fixed, the acquired count value itself can be used as the parameter indicating the frequency.

Figure 12:
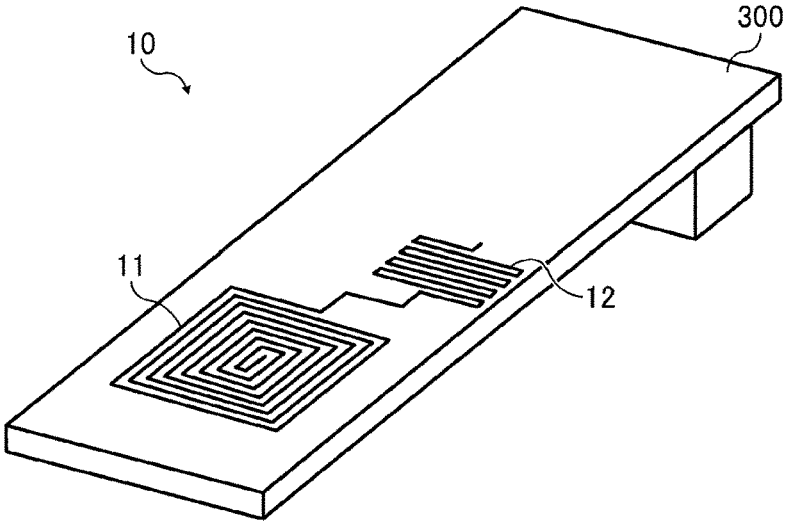
FIG. 12 is a perspective view illustrating an exterior of the magnetic flux sensor.

FIG. 12 is a perspective view illustrating an exterior of the magnetic flux sensor 10 according to the present embodiment. In FIG. 12, the face of the board 300, on which the coil pattern 11 and the resistor pattern 12 (described above with reference to FIG. 10) are disposed, is faced up. That is, a detection face for detecting magnetic permeability, which is to oppose the space subjected to magnetic permeability detection, is faced up. As illustrated in FIG. 12, the resistor pattern 12, which is connected serially to the coil pattern 11, is printed on the detection face on which the coil pattern 11 is printed. As described above with reference to FIG. 10, the coil pattern 11 is made of conducting wire (signal line) printed in a spiral shape on the board face. Additionally, the resistor pattern 12 is made of conducting wire printed in a serpentine or zigzag pattern on the board face, and the above-described function of the magnetic flux sensor 10 is established by these patterns. The coil pattern 11 and the resistor pattern 12 serve as a detecting portion of the magnetic flux sensor 10 according to the present embodiment. The magnetic flux sensor 10 is attached to the sub-hopper 90 with the detecting portion facing the vibration plate 201.

Next, descriptions are given below of a structure to acquire outputs from the magnetic flux sensor 10 in the image forming apparatus 100 according to the present embodiment, with reference to FIG. 13.

Figure 13:
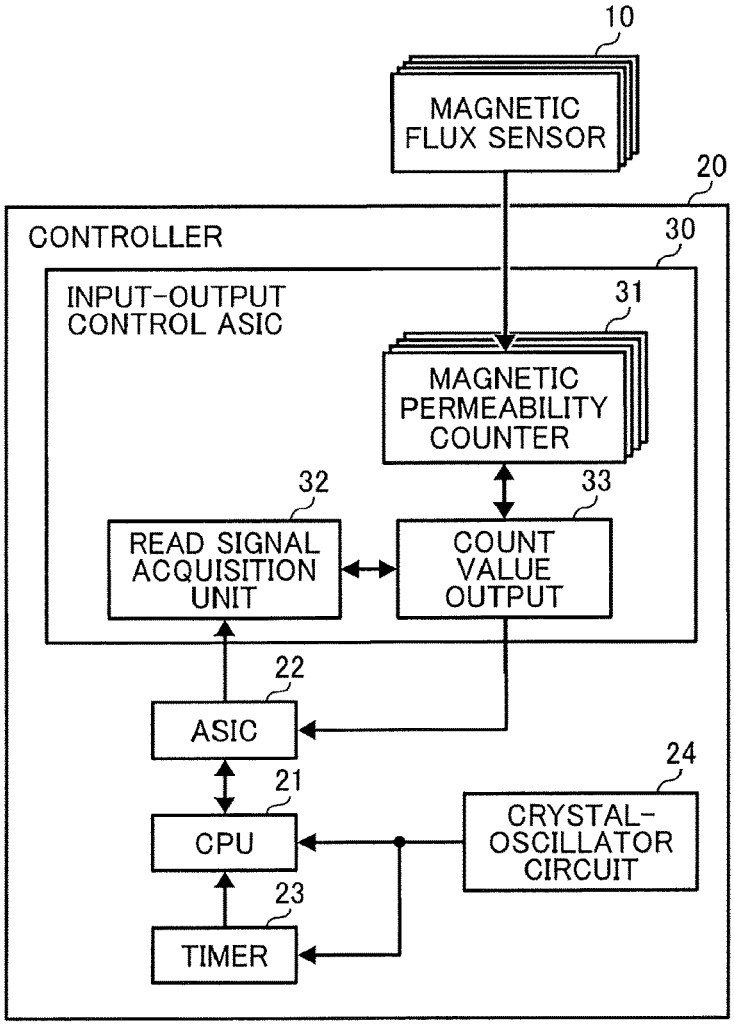
FIG. 13 is a schematic block diagram of a controller to acquire the signal from the magnetic flux sensor, according to an embodiment.

FIG. 13 is a schematic block diagram of the controller 20 to acquire the signal from the magnetic flux sensor 10. The controller 20 includes a central processing unit (CPU) 21, an application specific integrated circuit (ASIC) 22, a timer 23, a crystal-oscillator circuit 24, and an input-output control ASIC 30. The controller 20 can be a part of the controller 210 illustrated in FIG. 7. Alternatively, the controller 20 is connected to the controller 210 to be controlled thereby.

The CPU 21 is a computation unit and executes computation according to programs stored in a memory, such as a read only memory (ROM), to control operation of the entire controller 20. The ASIC 22 functions as a connection interface between a system bus, to which the CPU 21 and a random access memory (RANI) are connected, and another device. The timer 23 outputs an interrupt signal to the CPU 21 each time the count of reference clock input from the crystal-oscillator circuit 24 reaches a predetermined count. In response to the interrupt signal input from the timer 23, the CPU 21 outputs the read signal for acquiring the output value of the magnetic flux sensor 10. The crystal-oscillator circuit 24 generates the reference clock to operate respective elements inside the controller 20. The input-output control ASIC 30 acquires the signal output from the magnetic flux sensor 10 and converts the signals into data processable inside the controller 20. As illustrated in FIG. 13, the input-output control ASIC 30 includes a magnetic permeability counter 31, a read signal acquisition unit 32, and a count value output 33. As described above, the magnetic flux sensor 10 according to the present embodiment is an oscillator circuit that outputs a rectangular wave having the frequency corresponding to the magnetic permeability of the space as a detection target.

The magnetic permeability counter 31 increments the value according to the rectangular wave output from the magnetic flux sensor 10. That is, the magnetic permeability counter 31 serves as a target signal counter to count the number of the signal whose frequency is to be calculated. It is to be noted that, in the present embodiment, multiple magnetic flux sensors 10 are provided for the respective sub-hoppers 90 coupled to developing devices 112Y, 112M, 112C, and 112K, and multiple magnetic permeability counters 31 are used accordingly. The read signal acquisition unit 32 acquires, from the CPU 21 via the ASIC 22, the read signal, which is a command to acquire the count value of the magnetic permeability counter 31. Acquiring the read signal from the CPU 21, the read signal acquisition unit 32 inputs, to the count value output 33, a signal instructing output of the count value. According to the signal from the read signal acquisition unit 32, the count value output 33 outputs the count value of the magnetic permeability counter 31.

The CPU 21 has an access to the input-output control ASIC 30, for example, via a register. Accordingly, the CPU 21 writes a value in a predetermined register of in the input-output control ASIC 30 to output the above-described read signal. Additionally, the count value from the count value output 33 is stored in a predetermined register of the input-output control ASIC 30, from which the CPU 21 acquires the count value. The controller 20 illustrated in FIG. 13 is disposed in an apparatus (e.g., the image forming apparatus 100) or a device other than the magnetic flux sensor 10 in one embodiment. In another embodiment, the controller 20 is mounted, as a circuit including the CPU 21, on the board 300 of the magnetic flux sensor 10.

In the above-described structure, the CPU 21 detects the vibration state of the vibration plate 201 based on the count value acquired from the count value output 33 and, based on the detection result, detects the amount of developer in the sub-hopper 90. The count value output 33 serves as a frequency-related data output. That is, a detection result processor is implemented by the CPU 21 performing computation according to a predetermined program. The count value acquired from the count value output 33 is used as frequency-related data indicating the frequency of the magnetic flux sensor 10, which changes corresponding to the vibration of the vibration plate 201.

Figure 14:
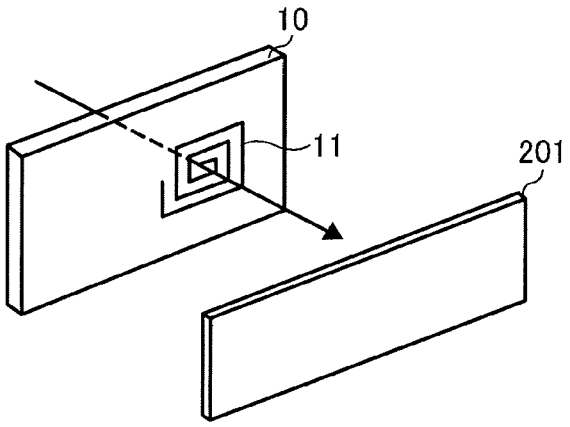
FIG. 14 illustrates relative positions of the magnetic flux sensor and a vibration plate, according to an embodiment.

Next, descriptions are given below of effects of the vibration plate 201 on the oscillation frequency of the magnetic flux sensor 10 according to the present embodiment. As illustrated in FIG. 14, the board face of the magnetic flux sensor 10 bearing the coil pattern 11 faces the vibration plate 201 via the case 93*b* of the sub-hopper 90. Then, a magnetic flux arises, centering around a center of the coil pattern 11, and the magnetic flux penetrates the vibration plate 201.

Figure 15:
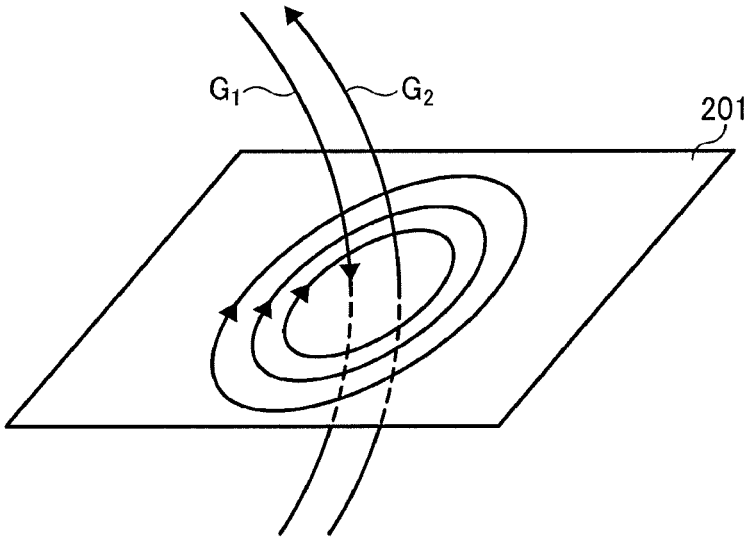
FIG. 15 illustrates actions of magnetic flux penetrating the vibration plate.

For example, the vibration plate 201 is made of a stainless steel plate. As illustrated in FIG. 15, an eddy current is generated in the vibration plate 201 as a magnetic flux $G_1$ penetrates the vibration plate 201. A magnetic flux $G_2$ is generated by the eddy current and acts to cancel the magnetic flux $G_1$ generated by the coil pattern 11. As the magnetic flux $G_1$ is thus canceled, the inductance L in the magnetic flux sensor 10 decreases. As defined by Formula 1 above, the oscillation frequency f increases as the inductance L decreases.

Figure 16:
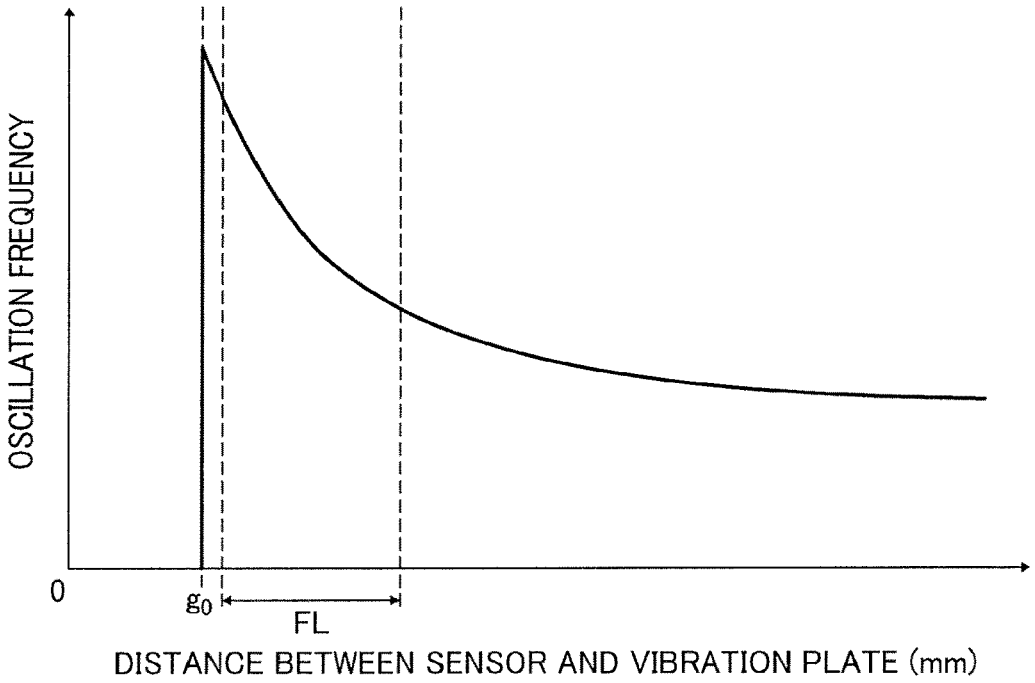
FIG. 16 is a graph of oscillation frequency of the magnetic flux sensor corresponding to a distance between the magnetic flux sensor and the vibration plate.

The strength of the eddy current, which occurs inside the vibration plate 201 due to the magnetic flux generated by the coil pattern 11, changes according to the strength of the magnetic flux as well as a distance between the coil pattern 11 and the vibration plate 201. FIG. 16 is a graph of oscillation frequency of the magnetic flux sensor 10 corresponding to the distance between the coil pattern 11 and the vibration plate 201. The strength of the eddy current occurring inside the vibration plate 201 is inversely proportional to the distance between the coil pattern 11 and the vibration plate 201. Accordingly, as the distance between the coil pattern 11 and the vibration plate 201 decreases, the oscillation frequency of the magnetic flux sensor 10 becomes higher. When the distance is smaller than a threshold, the inductance L is too low, and the magnetic flux sensor 10 does not oscillate.

In the sub-hopper 90 according to the present embodiment, the CPU 21 uses the characteristics illustrated in FIG. 16 to detect the vibration of the vibration plate 201 based on the oscillation frequency of the magnetic flux sensor 10. The amount of developer in the sub-hopper 90 is detected based on the vibration of the vibration plate 201 thus detected. In other words, the vibration plate 201 and the magnetic flux sensor 10 illustrated in FIG. 14 as well as the structure to process the signal output from the magnetic flux sensor 10 is used as a powder detector according to the present embodiment. The magnetic flux sensor 10 serves as a vibration detector.

The vibration of the vibration plate 201 flipped by the torsion spring 203 is expressed by an eigenfrequency and an attenuation ratio determined by external factors that absorb the vibration energy. The eigenfrequency is defined by rigidity of the vibration plate 201 and weight of the projection 202 (refer to FIG. 17). The external factors to absorb the vibration energy include the presence of developer that contacts the vibration plate 201 in the sub-hopper 90, in addition to fixed factors such as the holding strength of the mount 201*a* cantilevering the vibration plate 201 and air resistance. The amount or state of developer that contacts the vibration plate 201 in the sub-hopper 90 changes depending on the amount of developer in the sub-hopper 90. Accordingly, by detecting the vibration of the vibration plate 201, the amount of developer remaining in the sub-hopper 90 is detected. In the sub-hopper 90 according to the present embodiment, the torsion spring 203, disposed on the first stirring conveyor 96 to stir developer, flips the vibration plate 201 and vibrates the vibration plate 201 periodically according to the rotation cycle.

Figure 17:
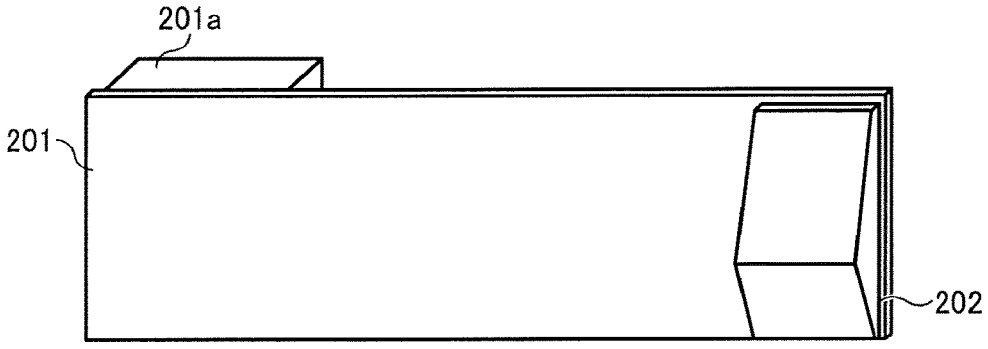
FIG. 17 is a perspective view illustrating a component layout around the vibration plate.
Figure 18:
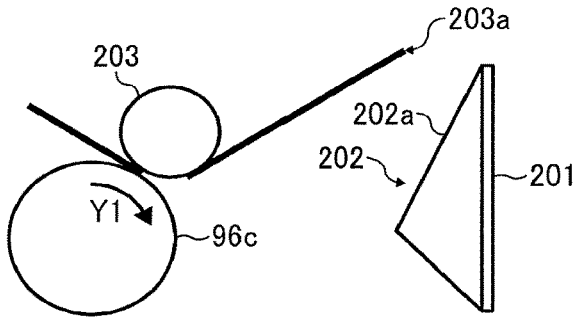
FIG. 18 is a side view illustrating a rotation position of the rotation shaft, at which the torsion spring is about to contact a projection on the vibration plate.

Next, descriptions are given below of placement of components around the vibration plate 201 in the sub-hopper 90 and the structure for the torsion spring 203 to flip the vibration plate 201. FIG. 17 is a perspective view illustrating a component layout around the vibration plate 201. As illustrated in FIG. 17, the vibration plate 201 is secured via a mount 201*a* to the case 93*b* of the sub-hopper 90. FIG. 18 is a side view illustrating a rotation position of the rotation shaft 96*c*, at which the torsion spring 203 is about to contact the projection 202. Specifically, the portion of the torsion spring 203 that contacts the projection 202 is referred to as a contact portion 203*a*. The rotation shaft 96*c* rotates so that the torsion spring 203 rotates clockwise in FIG. 18. The torsion spring 203 is an elastic body attached to the rotation shaft 96*c* via a holder 205 (illustrated in FIG. 27A). The torsion spring 203 is constantly biased in the direction in which the rotation shaft 96*c* rotates (clockwise in the drawing).

As illustrated in FIG. 18, the projection 202 projects from a face (on the front side of paper on which the drawing is drawn) of the vibration plate 201 and inclined relative to the face of the vibration plate 201 when viewed from a lateral side. Specifically, the projection 202 has an inclined face 202*a* that approaches the rotation shaft 96*c* along the direction of rotation of the torsion spring 203. When the torsion spring 203 flips the vibration plate 201 to vibrate, the contact portion 203*a* of the torsion spring 203 pushes the inclined face 202*a* of the projection 202.

Figure 19:
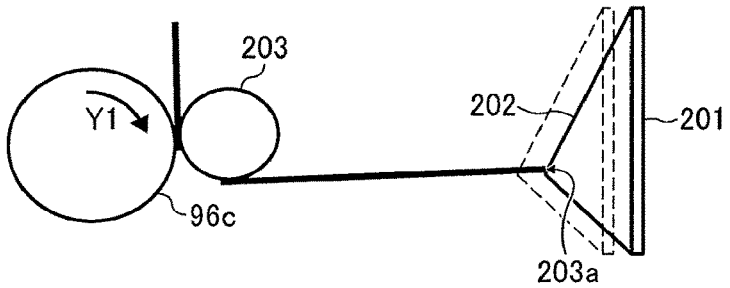
FIG. 19 is a side view of the torsion spring rotated further from the position illustrated in FIG. 18.

FIG. 19 is a side view of the torsion spring 203 positioned downstream in the direction indicated by arrow Y1 from the position illustrated in FIG. 18. As the torsion spring 203 rotates further with the contact portion 203*a* kept in contact with the projection 202, the vibration plate 201 is pushed and deformed along the inclined face 202*a*. In FIG. 19, broken lines represent positions of the vibration plate 201 and the projection 202 in a state in which no external force is applied thereto (hereinafter "stationary state"). As illustrated in FIG. 19, the contact portion 203*a* of the torsion spring 203 pushes the projection 202 on the vibration plate 201.

Since the vibration plate 201 is secured via the mount 201*a* to the case 93*b* of the sub-hopper 90, the position of the first end of the vibration plate 201 on the side of the mount 201*a* does not change. By contrast, the opposite end (i.e., a free end) of the vibration plate 201, in which the projection 202 is disposed, is pushed by the torsion spring 203 and moves to the side opposite to the rotation shaft 96*c*. Consequently, the vibration plate 201 deforms, starting from the mount 201*a*. Energy to vibrate the vibration plate 201 is accumulated in the vibration plate 201 being in the deformed state.

Figure 20:
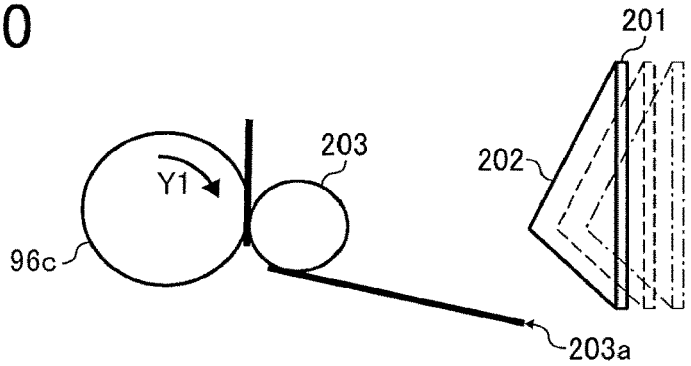
FIG. 20 is a side view of the torsion spring rotated further from the position illustrated in FIG. 19.
Figure 21:
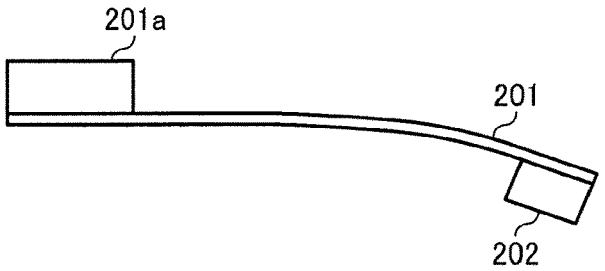
FIG. 21 is a top view of the vibration plate.

FIG. 20 is a side view of the torsion spring 203 positioned downstream in the direction indicated by arrow Y1 from the position illustrated in FIG. 19. In FIG. 20, broken lines represents the position (i.e., a predetermined position) of the vibration plate 201 being in the stationary state, and alternate long and short dashed lines represent the position of the vibration plate 201 illustrated in FIG. 19. When the vibration energy, which has been accumulated by the contact portion 203*a* of the torsion spring 203 pushing the vibration plate 201, is released, the vibration plate 201 deforms to the opposite side as represented by solid lines. FIG. 21 is a top view of the vibration plate 201. As illustrated in FIG. 20, when the pushing force given to the projection 202 by the torsion spring 203 is released, owing to the energy of deformation accumulated in the vibration plate 201, the free end of the vibration plate 201, provided with the projection 202, deforms and moves to the opposite side. In the state illustrated in FIGS. 20 and 21, the vibration plate 201 is away from the magnetic flux sensor 10, which faces the vibration plate 201 via the case 93*b* of the sub-hopper 90. Subsequently, while vibrating, the vibration plate 201 repeatedly approaches the magnetic flux sensor 10 closer than the stationary state and draws away therefrom further than the stationary state. Then, the vibration plate 201 returns to the stationary state as the vibration attenuates.

Figure 22:
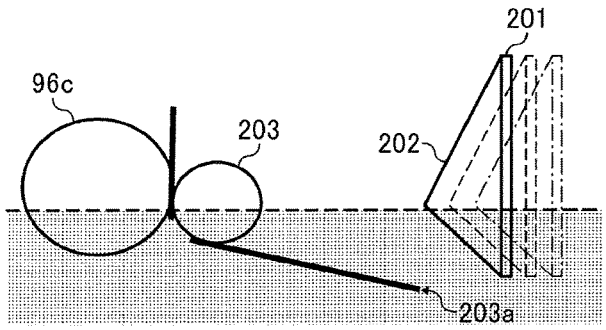
FIG. 22 schematically illustrates a state of developer, which is represented by dots, stored in the sub-hopper.

FIG. 22 schematically illustrates a state of developer (represented by dots) stored in the sub-hopper 90. When the developer is present in the sub-hopper 90 as illustrated in FIG. 22, the vibration plate 201 and the projection 202 contact the developer while vibrating. Accordingly, compared with a state in which the sub-hopper 90 is empty, the vibration of the vibration plate 201 attenuates early. According to changes in attenuation of vibration, the amount of developer in the sub-hopper 90 is detected.

Figure 23:
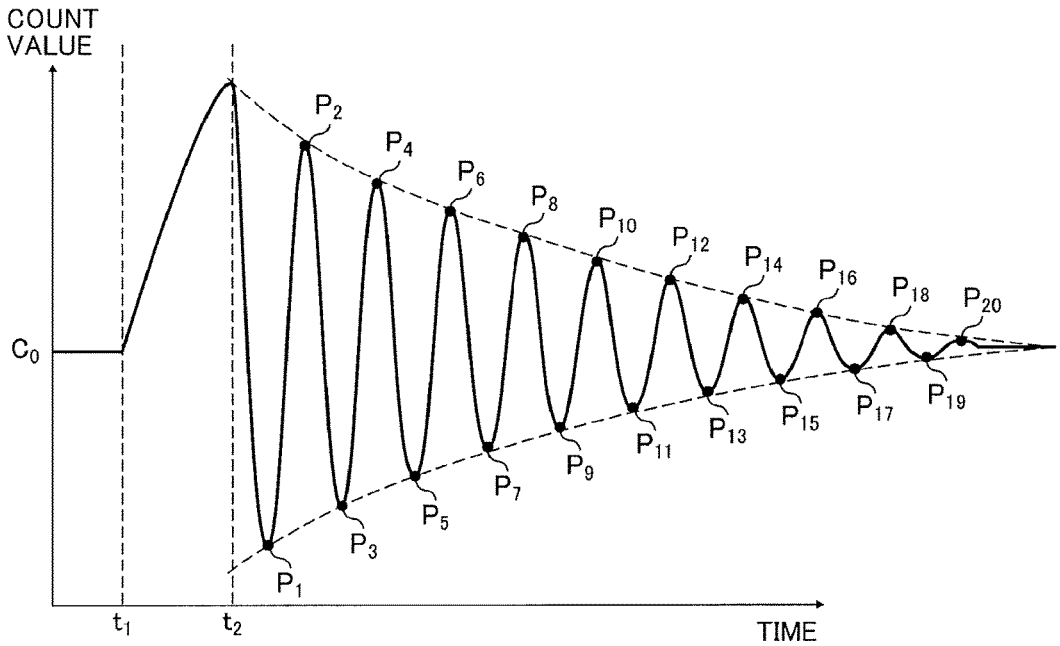
FIG. 23 is a graph of changes in the count of the oscillation signal from the magnetic flux sensor from when the torsion spring flips the projection until the vibration of the vibration plate ceases.

FIG. 23 is a graph of changes in the count value of the oscillation signal from the magnetic flux sensor 10 per counting period from when the torsion spring 203 flips the projection 202 until the vibration of the vibration plate 201 attenuates to cease. The count value of the oscillation signal increases as the oscillation frequency becomes higher. Accordingly, the count value indicated by the ordinate in FIG. 23 is replaceable with the oscillation frequency. As illustrated in FIG. 23, at Time point $t_1$, the contact portion 203*a* of the torsion spring 203 contacts and pushes the projection 202, and the vibration plate 201 approaches the magnetic flux sensor 10. Then, the oscillation frequency of the magnetic flux sensor 10 increases, and the count value per counting period increases. At Time point $t_2$, the torsion spring 203 stops pushing the projection 202. Subsequently, the vibration plate 201 vibrates owing to the accumulated vibration energy. As the vibration plate 201 vibrates, the distance between the magnetic flux sensor 10 repeatedly increases and decreases from that distance in the stationary state. Consequently, the frequency of the oscillation signal of the magnetic flux sensor 10 fluctuates inherent to the vibration of the vibration plate 201, and the count value per counting period fluctuates similarly.

The amplitude of vibration of the vibration plate 201 becomes narrower as the vibration energy is consumed. That is, the vibration of the vibration plate 201 attenuates with elapse of time. Accordingly, the change in distance between the vibration plate 201 and the magnetic flux sensor 10 decreases with elapse of time. Similarly, the change in count value changes with elapse of time. As described above, the vibration of the vibration plate 201 attenuates earlier when the amount of developer remaining in the sub-hopper 90 is greater. Accordingly, how the vibration of the vibration plate 201 attenuates is recognizable based on the analysis of the attenuation manner of the oscillation signal from the magnetic flux sensor 10 illustrated in FIG. 23. Then, the amount of developer in the sub-hopper 90 is recognizable. Referring to FIG. 23, when $P_1$, $P_2$, $P_3$, $P_4$ . . . represent the peaks of the count values of the oscillation signal, respectively, an attenuation ratio ζ of the vibration of the vibration plate 201 can be obtained by, for example, Formula 2 below.

$$\zeta = \frac{P_6 - P_5}{P_2 - P_1} \qquad \text{Formula 2}$$

Referring to the change ratio between one peak value and another peak value acquired at different time points as expressed by Formula 2, errors caused by environmental changes are canceled, thereby attaining more accurate attenuation ratio. Specifically, in Formula 2, the ratio between the difference between $P_2$ and $P_1$, and the difference between $P_6$ and $P_5$ is calculated. In other words, the CPU 21 according to the present embodiment obtains the attenuation ratio based on the ratio of the count values acquired at different time points.

It is to be noted that, in Formula 2, use of Peaks $P_1$ and $P_2$, and Peaks $P_5$ and $P_6$, out of the peaks illustrated in FIG. 23, is an example, and other peaks can be used instead. However, it is preferable to exclude the peak at Time point $t_2$, at which the vibration plate 201 pushed by the torsion spring 203 is closest to the magnetic flux sensor 10, since the peak at Time point $t_2$ includes error. For example, the friction between the torsion spring 203 and the projection 202 causes a sliding noise, which is superimposed on the peak. Even if the developer in the sub-hopper 90 accelerates the attenuation of the vibration, as illustrated in FIG. 22, the vibration frequency of the vibration plate 201 does not change significantly. Accordingly, the attenuation of amplitude in the specific period can be calculated from the calculated ratio of the amplitude of specific peaks as expressed in Formula 2.

Next, descriptions are given below of detection of developer amount in the sub-hopper 90 according to the present embodiment with reference to a flowchart illustrated in FIG. 24.

Figures 24, 25:
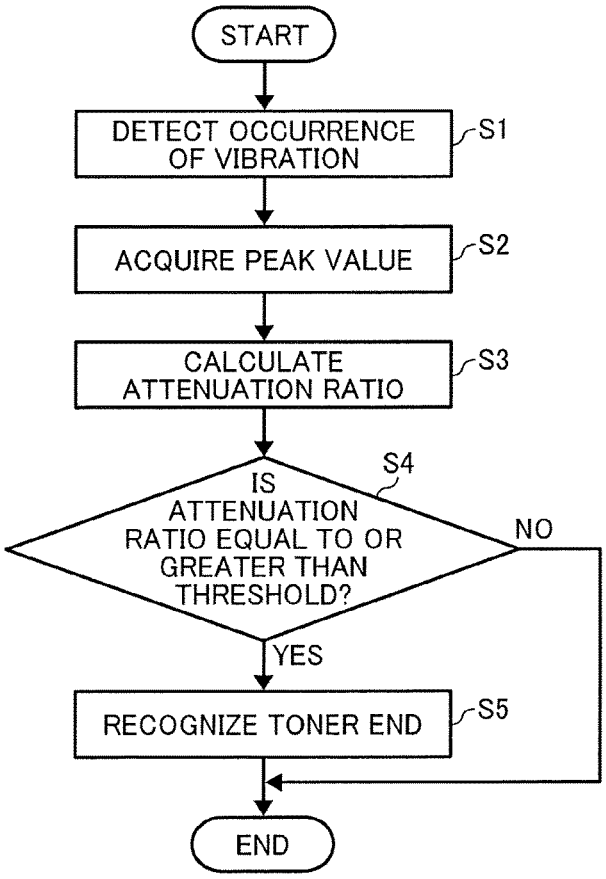
FIG. 24 is a flowchart of developer amount detection in the sub-hopper, according to an embodiment.
FIG. 25 is a table of data in count value analysis according to an embodiment.

FIG. 24 illustrates a flow of actions of the CPU 21 illustrated in FIG. 13. As illustrated in FIG. 24, at S1, the CPU 21 detects the occurrence of vibration as the torsion spring 203 pushes the projection 202 as illustrated in FIG. 19. As described above, the CPU 21 acquires, from the count value output 33, the count value of the signal output from the magnetic flux sensor 10 per counting period. In the stationary state, the count value is $C_0$ as illustrated in FIG. 23. By contrast, as the projection 202 is pushed as illustrated in FIG. 19 and the vibration plate 201 approaches the magnetic flux sensor 10 accordingly, the count value increases. Accordingly, at S1, the CPU 21 detects the occurrence of vibration when the count value acquired from the count value output 33 exceeds a threshold.

Regardless of step S1, the CPU 21 keeps acquiring the count value per counting period. At S2, the CPU 21 acquires the peak value of fluctuation of the count value, which accords with the vibration of the vibration plate 201 illustrated in FIG. 23. The CPU 21 continuously analyzes the count value acquired in each counting period, thereby identifying the peak.

FIG. 25 is a table of data of count analysis. The data in FIG. 25 include "number n", "count value $S_n$" acquired in each counting period, and the sign (+ or −) of the difference ($S_{n-1}-S_n$) between each count value $S_n$ and the immediately preceding count value $S_{n-1}$. The "number n", "count value $S_n$", and the sign (+ or −) are arranged in the order of acquisition. In the data illustrated in FIG. 25, the peak is immediately before the sing of "$S_{n-1}-S_n$" is inverted. In the case illustrated in FIG. 25, "5" and "10" are adopted as peaks. That is, subsequent to S1, the CPU 21 calculates "$S_{n-1}-S_n$" in FIG. 25 regarding the count values sequentially acquired. The count value $S_n$ of the number n immediately before the sign of "$S_{n-1}-S_n$" is inverted is adopted as $P_1$, $P_2$, $P_3$ . . . illustrated in FIG. 23.

As described above, it is preferred to avoid the count value at Timing $t_2$, which is an initial peak after the step S1. Accordingly, the CPU 21 discards the initial peak of the extracted peaks through the analysis illustrated in FIG. 25. Additionally, in practice, it is possible that the count value include noise of high frequency component, and the sign of "$S_{n-1}-S_n$" may be inverted at a timing different from the timing at which the vibration of the vibration plate 201 is at the peak. To avoid erroneous detection in such cases, preferably the CPU 21 smooths the values acquired from the count value output 33, before analyzing the values as illustrated in FIG. 25. The acquired values can be smoothed through common methods such as moving average.

Using the peak values thus obtained, at S3, the CPU 21 calculates the attenuation ratio ζ according to Formula 2 mentioned above. For that, the count value analysis illustrated in FIG. 25 is continued at S2 until the peaks used in the attenuation ratio calculation are attained. In the case of Formula 2, the CPU 21 analyzes the count values until the peak value equivalent to Peak $P_6$ is attained.

At S4, the CPU 21 determines whether the attenuation ratio ζ calculated at S3 is equal to or smaller than the threshold. In other words, the CPU 21 determined whether the amount of developer in the sub-hopper 90 is below the predetermined amount based on the comparison between the rate of the count values acquired at different time points and the threshold. As described above with reference to FIG. 22, when a sufficient amount of developer is in the sub-hopper 90, the vibration of the vibration plate 201 attenuates early, and the attenuation ratio ζ is smaller.

As the amount of developer in the sub-hopper 90 decreases, the attenuation of the vibration of the vibration plate 201 is slowed, and the attenuation ratio increases. Accordingly, when the threshold is set to the attenuation ratio ζ corresponding to the amount of remaining developer to be detected, whether the amount of developer remaining in the sub-hopper 90 falls to the amount to be detected (hereinafter "prescribed amount") can be determined based on the calculated attenuation ratio ζ.

The amount of developer in the sub-hopper 90 does not directly affect the attenuation manner of vibration of the vibration plate 201. According to the amount of remaining developer, the manner of contact of developer with the vibration plate 201 changes, and the manner of contact defines the manner of attenuation of vibration of the vibration plate 201. Therefore, even if the amount of developer in the sub-hopper 90 is the same, the vibration of the vibration plate 201 attenuates differently if the manner of contact between the vibration plate 201 and developer is different. By contrast, in the present embodiment, the torsion spring 203 constantly stirs the developer in the sub-hopper 90, in detection of developer amount in the sub-hopper 90. Accordingly, to a certain degree, the state of contact of developer with the vibration plate 201 is determined with the amount of remaining developer. This configuration can avoid the inconvenience that the detection result differs depending on the manner of contact between the vibration plate 201 and developer even if the remaining amount is the same.

When the CPU 21 determines that the calculated attenuation ratio ζ is below the threshold (No at S4), the CPU 21 determines that the amount of developer in the sub-hopper 90 is equal to or greater than the prescribed amount and completes the processing. By contrast, when the calculated attenuation ratio ζ is equal to or greater than the threshold (Yes at S4), the CPU 21 determines that the amount of developer in the sub-hopper 90 is below the prescribed amount and, at S5, detects the developer end in the sub-hopper 90. Then, the processing is completed. Detecting the developer end at S5, the CPU 21 outputs a signal indicating that the amount of remaining developer is below the prescribed amount, to an upper level controller to control the image forming apparatus 100. With this signal, the controller of the image forming apparatus 100 recognizes the end of developer of specific color and becomes capable of supplying developer from the developer bottle 117.

Figure 26:
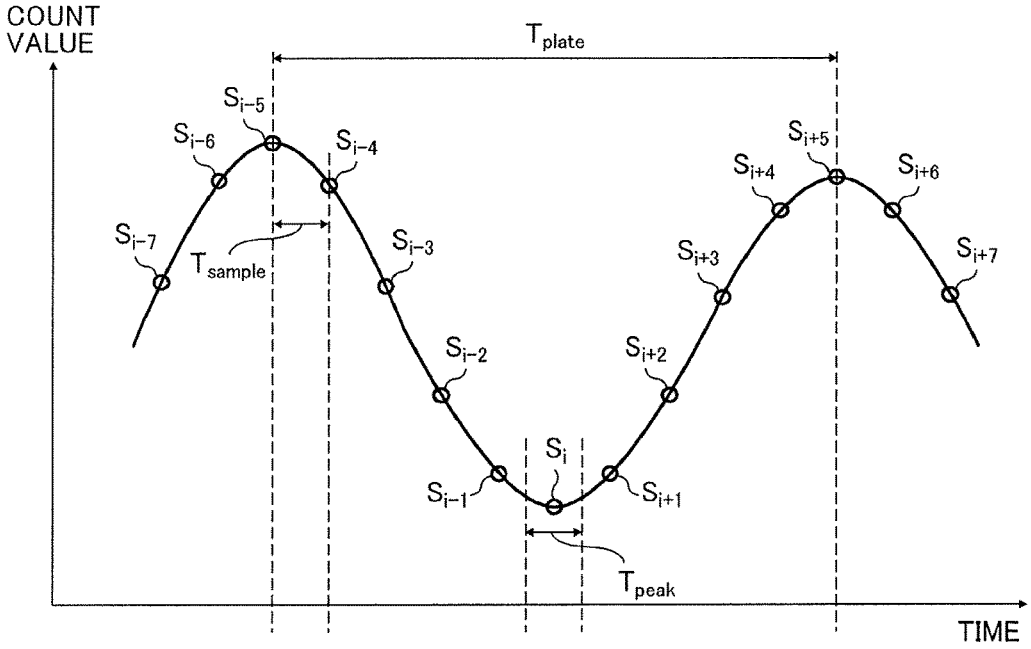
FIG. 26 is a chart of count values sampled during a single vibration cycle of the vibration plate.

Next, descriptions are given below of the relation between the oscillation frequency of the magnetic flux sensor 10, the cycle in which the CPU 21 acquires the count values (hereinafter "sampling cycle"), and the eigenfrequency of the vibration plate 201. FIG. 26 is a chart of count values sampled during a single vibration cycle of the vibration plate 201. In FIG. 26, the vibration cycle of the vibration plate 201 is represented by "$T_{plate}$", and the sampling cycle is represented by "$T_{sample}$".

To calculate, at a higher degree, the attenuation ratio ζ of the vibration of the vibration plate 201 through the method illustrated in FIGS. 23 through 25, it is necessary to acquire the peak value of vibration of the vibration plate 201 accurately. For that, preferably, the number of sampled count values in the vibration cycle $T_{plate}$ is sufficient, and the sampling cycle $T_{sample}$ is small enough relative to the vibration cycle $T_{plate}$.

In the case illustrated in FIG. 26, the number of count values sampled in one vibration cycle $T_{plate}$ is 10. That is, the sampling cycle $T_{sample}$ is 1/10 of the vibration cycle T. In the case illustrated in FIG. 26, the count value $S_i$ is inevitably sampled during a peak period $T_{peak}$ of the count value, and thus the peak value can be acquired with a higher degree of accuracy.

Accordingly, for example, when the sampling cycle $T_{sample}$ for the CPU 21 to acquire the count values is 1 ms, the vibration cycle $T_{plate}$ of the vibration plate 201 is preferably 10 ms or greater. In other words, regarding a sampling frequency 1000 Hz of the CPU 21, the eigenfrequency of the vibration plate 201 is preferably about 100 Hz and, more preferably, not greater than 100 Hz. Such an eigenfrequency of the vibration plate 201 is attained by adjusting the material of the vibration plate 201, the dimension (including thickness) of the vibration plate 201, and the weight of the projection 202.

By contrast, if the count value acquired per each sampling cycle is too small, changes in the sampled count values corresponding to the vibration of the vibration plate 201 are small, and accurately calculating the attenuation ratio ζ becomes difficult. Here, the count value sampled conforms to the oscillation frequency of the magnetic flux sensor 10. Typically, the oscillation frequency of the magnetic flux sensor 10 is of the order of several megahertz (MHz). When the sampling is performed at a sampling frequency of 1000 Hz, 1000 count values or greater are obtained at each sampling timing. According to the order of the vibration cycle $T_{plate}$ and the sampling cycle $T_{sample}$, the attenuation ratio ζ can be calculated accurately.

However, the amplitude of fluctuation of the count values relative to time illustrated in FIG. 23 is small if the change in the oscillation frequency of the magnetic flux sensor 10 is insufficient relative to the change in distance between the magnetic flux sensor 10 and the vibration plate 201. The change in distance therebetween is defined by the vibration of the vibration plate 201. As a result, the change in the attenuation ratio also becomes smaller, thereby degrading the accuracy in detecting the amount of remaining developer, using the vibration of the vibration plate 201. To increase the change in oscillation frequency of the magnetic flux sensor 10 corresponding to the change in distance between the magnetic flux sensor 10 and the vibration plate 201, the distance therebetween is determined based on the characteristics illustrated in FIG. 16. For example, the distance between the magnetic flux sensor 10 and the vibration plate 201 (in the stationary state) is preferably set to the distance that corresponds to the range in which the oscillation frequency changes steeply corresponding to the distance therebetween, such as the range FL in FIG. 16.

Figure 27A:
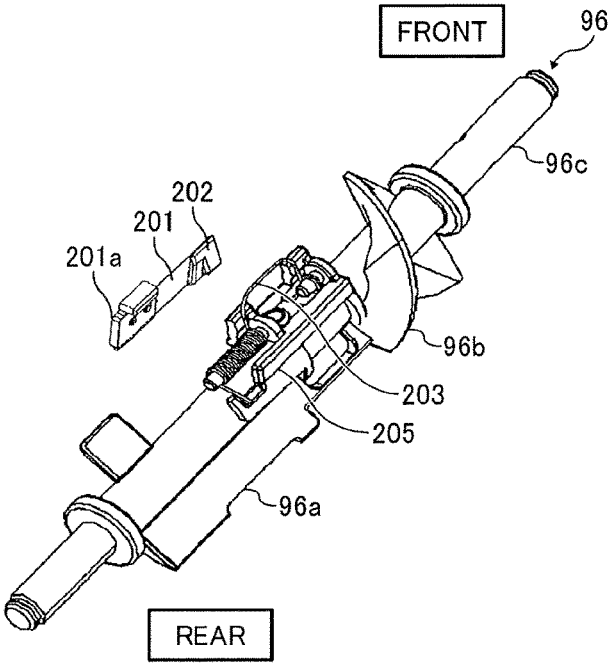
FIG. 27A is a perspective view of a structure to vibrate the vibration plate, according to an embodiment.
Figure 27B:
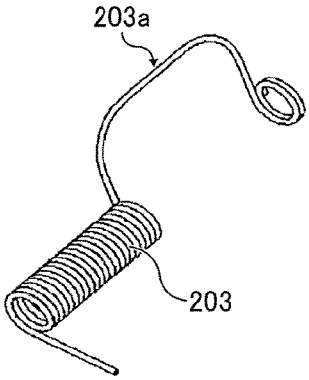
FIG. 27B is a perspective view of a torsion spring in the structure illustrated in FIG. 27A.

FIG. 27A is a perspective view of a structure to vibrate the vibration plate 201. FIG. 27B is a perspective view of the torsion spring 203.

In the present embodiment, the torsion spring 203 is used to vibrate the vibration plate 201. The vibration plate 201 is secured to the case 93*b* of the sub-hopper 90 via the mount 201*a*, which is disposed on one end of the vibration plate 201 in the direction parallel to the axial direction of the rotation shaft 96*c* (see FIG. 6). The projection 202 (i.e., a weight) that is triangular in cross section is disposed on the other end of the vibration plate 201. The projection 202 projects from the face of the vibration plate 201 facing the rotation shaft 96*c*. The projection 202 includes the first inclined face 202*a*, an apex 202*b*, and a second inclined face 202*c* arranged in that order in the rotation direction of the rotation shaft 96*c* (see FIG. 28). The first inclined face 202*a* is inclined to approach the rotation shaft 96*c* in the rotation direction of the rotation shaft 96*c*. The second inclined face 202*c* is inclined to draw away from the rotation shaft 96*c* in the rotation direction of the rotation shaft 96*c*. That is, the second inclined face 202*c* is inclined to reduce the projecting amount of the projection 202 in the rotation direction of the torsion spring 203. The first inclined face 202*a* and the second inclined face 202*c* are connected together at the apex 202*b*.

The torsion spring 203 is secured via the holder 205 to the rotation shaft 96*c* of the first stirring conveyor 96. As the rotation shaft 96*c* rotates, the torsion spring 203 rotates together with the rotation shaft 96*c*. As the torsion spring 203 rotates, the contact portion 203*a* thereof contacts the projection 202. Then, the torsion spring 203 pushes the projection 202 to the case 93*b*, and the vibration plate 201 elastically deforms. As the torsion spring 203 rotates further from the position to push the projection 202, the contact portion 203*a* of the torsion spring 203 is disengaged from the projection 202, flipping the vibration plate 201. Then, the vibration plate 201 vibrates with the force to return to the predetermined position in the stationary state.

A preferable material for the torsion spring 203 is elastic wire made of, for example, hard drawn steel wire type C (SW-C), piano wire type A (SWP-A), piano wire type B (SWP-B), or stainless steel spring wire, for example, Steel Special Use Stainless (SUS) 304-WPB according to Japanese Industrial Standards (JIS). However, the material for the torsion spring 203 is not limited thereto. Although the torsion spring 203 in the present embodiment is a single torsion spring, in which a torsion coiled spring is disposed on one side, the shape of the torsion spring 203 is not limited thereto. For example, a double torsion spring can be used instead. The force with which the torsion spring 203 pushes the vibration plate 201 is adjustable with the material of the torsion spring 203 or the number of turns of the coiled portion thereof. Thus, the force of the torsion spring 203 to push the vibration plate 201 can be changed as required. For example, the force is changed between the case where one-component developer (i.e., toner) is used and the case where two-component developer is used. It is to be noted that the contact member to flip the vibration plate 201 is not limited to the torsion spring 203. For example, a wire piece or a rod can be used. This configuration can reduce the area of contact between the projection 202 of the vibration plate 201 and the contact member and accordingly inhibit toner aggregation.

Figure 28:
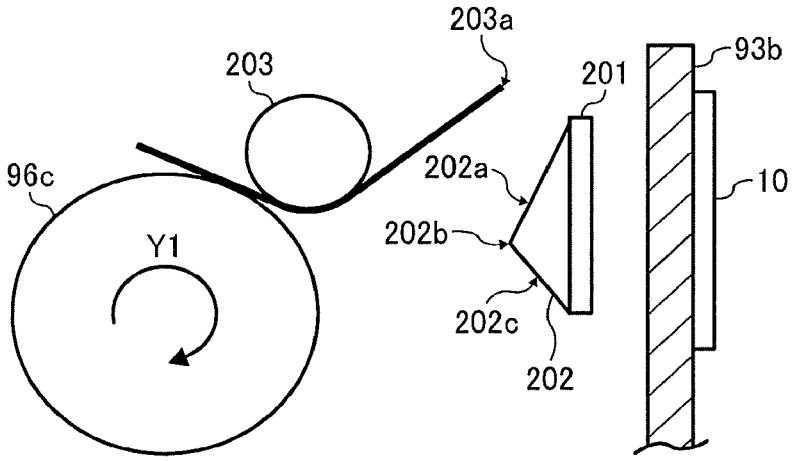
FIG. 28 is a schematic view illustrating a state before the torsion spring, which is attached via a holder to the rotation shaft, contacts the projection on the vibration plate in the structure illustrated in FIG. 27A.

FIG. 28 is a schematic view illustrating a state before the contact portion 203*a* of the torsion spring 203 contacts the projection 202 attached to the vibration plate 201.

The torsion spring 203 is attached, via the holder 205, to the rotation shaft 96*c* of the first stirring conveyor 96. The torsion spring 203 rotates clockwise in FIG. 28, together with the rotation shaft 96*c* of the first stirring conveyor 96. The projection 202 attached to the vibration plate 201 includes the first inclined face 202*a* (i.e., an upstream inclined face), the apex 202*b*, and the second inclined face 202*c* (i.e., a downstream inclined face) disposed in the rotation direction of the torsion spring 203 (the rotation shaft 96*c*) indicated by arrow Y1. The first inclined face 202*a* is inclined to rise, from the face of the vibration plate 201 facing the rotation shaft 96*c*, in the rotation direction indicated by arrow Y1. The second inclined face 202*c* is inclined to descend, toward the face of the vibration plate 201 facing the rotation shaft 96*c*, in the rotation direction indicated by arrow Y1. At the apex 202*b* connecting the first inclined face 202*a* to the second inclined face 202*c*, the height of the projection 202 from the face of the vibration plate 201 facing the rotation shaft 96*c* is highest. The shape of the apex 202*b* is not limited to a pointed shape but can be a rounded shape or a flat shape.

Next, descriptions are given below of examples (Embodiments 1 through 3) of driving timings of respective members in the developer supply device.

Embodiment 1

Figure 29:
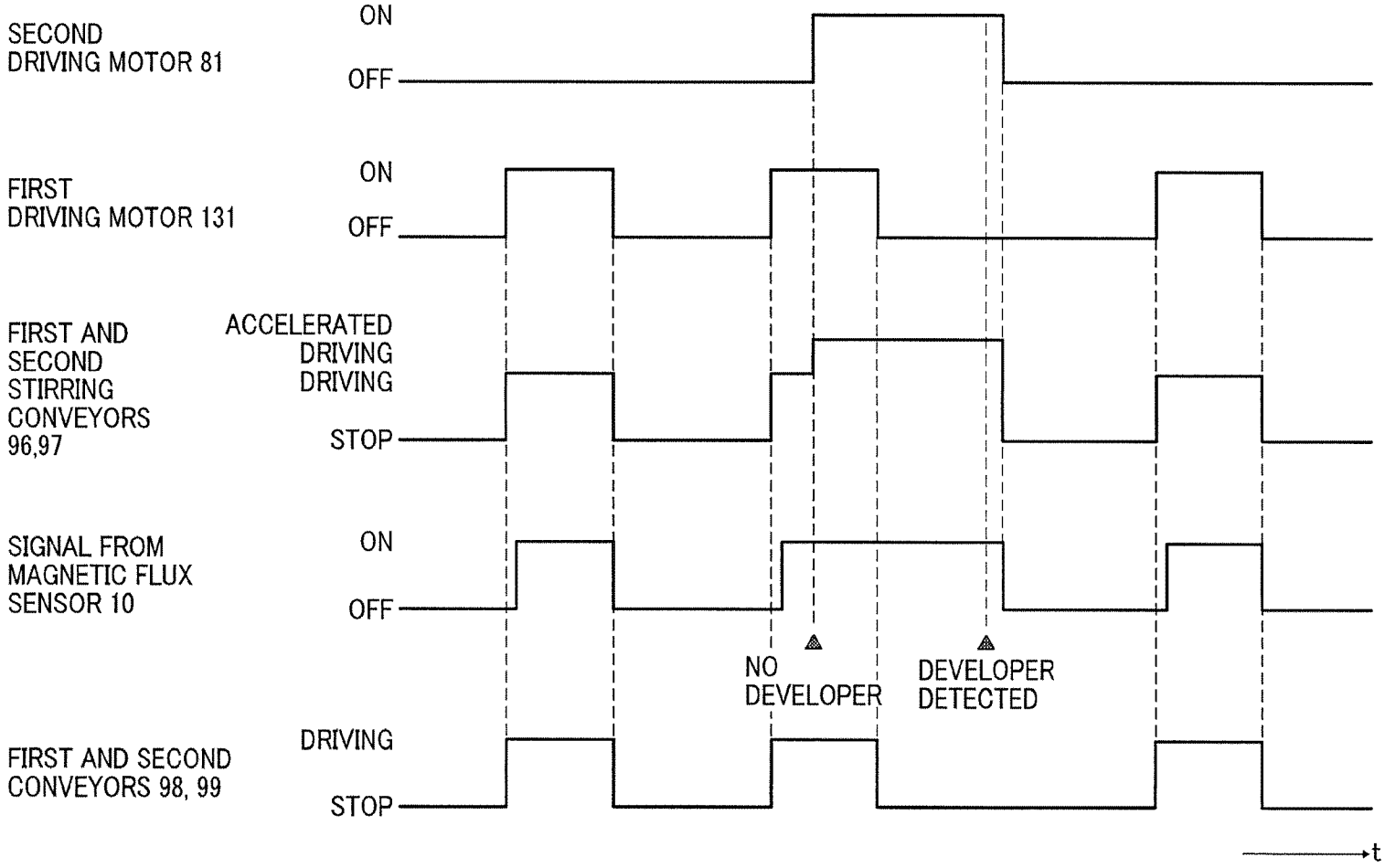
FIG. 29 is a timing chart illustrating an example of driving respective members in a developer supply device according to Embodiment 1.

FIG. 29 is a timing chart illustrating driving of the respective members in the developer supply device according to Embodiment 1.

In FIG. 29, when the first driving motor 131 is turned on according to a control instruction from the controller 210, the first and second stirring conveyors 96 and 97 to stir the developer in the sub-hoppers 90 as well as the first and second conveyors 98 and 99 to transport the developer from the sub-hopper to the developing device 112 simultaneously start driving. The torsion spring 203 disposed at the rotation shaft 96*c* taps the vibration plate 201 as the first stirring conveyor 96 rotates. Detecting the vibration of the vibration plate 201, the vibration plate 201 outputs a detection signal. The magnetic flux sensor 10 outputs the detection signal with a slight delay after the first driving motor 131 is turned on. Based on this detection signal, the controller 210 detects whether the developer is present (smaller or not smaller than the predetermined amount) in the developer reservoir 90*a*. When the controller 210 does not detect the signal indicating "no developer" in the developer reservoir 90*a*, and a sufficient amount of the developer is supplied to the developing device 112, the controller 210 turns off the first driving motor 131. At this point, the first and second stirring conveyors 96 and 97 and the first and second conveyors 98 and 99 stop driving. Additionally, as the first stirring conveyor 96 is stopped, the magnetic flux sensor 10 stops outputting the detection signal.

Thereafter, the first driving motor 131 is turned on again, and the first and second stirring conveyors 96 and 97 and the first and second conveyors 98 and 99 simultaneously start driving. Then, the magnetic flux sensor 10 outputs the detection signal in accordance with the driving of the first stirring conveyor 96. Here, when the controller 210 detects the detection signal, from the magnetic flux sensor 10, indicating "no developer" in the developer reservoir 90*a*, the controller 210 turns on the second driving motor 81. Consequently, the developer is supplied to the developer reservoir 90*a* from the developer bottle 117, and, at the same time, rotation speeds of the first and second stirring conveyors 96 and 97 increase to promote stirring of the developer in the developer reservoir 90*a*.

Subsequently, once a sufficient amount of the developer is supplied to the developing device 112, the controller 210 turns off the first driving motor 131. The first and second conveyors 98 and 99 stop driving since the first driving motor 131 has stopped. The first and second stirring conveyors 96 and 97, however, are continuously driven by the second driving motor 81. When the controller 210 detects the detection signal from the magnetic flux sensor 10 indicating that the developer is present in the developer reservoir 90*a*, the controller 210 turns off the second driving motor 81 after a predetermined time period (e.g., one second) elapses. Consequently, the first and second stirring conveyors 96 and 97 stop driving. Since the first stirring conveyor 96 is stopped, the magnetic flux sensor 10 stops outputting the detection signal. Later on, the controller 210 repeats the control operation described above.

Here, in a case where a pressure (piezoelectric) sensor is used, the amount of the developer (or whether the developer is present or not) in the developer reservoir 90*a* can be constantly detected. By contrast, in Embodiment 1, the detection is limited to a time period during which the first stirring conveyor 96 is driven and the magnetic flux sensor 10 outputs the detection signal. Specifically, the detection of the amount of the developer (whether the developer is present) by the controller 210 is limited to the time period during which the first stirring conveyor 96 is driving. When a detection time period for the amount of the developer is short, there is a risk of detection failure. For example, detection failure occurs near the end of the developer, at which the developer remaining amount in the developer bottle 117 is small and the amount, per unit time, of developer discharged is reduced. Detection failure can also occur while the sub-hopper 90 (in particular, the developer reservoir 90*a* thereof) is filled with developer (i.e., recovery filling) immediately after the developer bottle 117 is replaced with a new one. Due to detection failure, the developer supply from the developer bottle 117 may become insufficient, resulting in the shortage of the developer in the developer reservoir 90*a* or insufficient toner concentration in the developing device 112.

In Embodiment 1, at least while the second driving motor 81 is driven to supply the developer from the developer bottle 117 to the developer reservoir 90*a*, the first stirring conveyor 96 is driven to enable the magnetic flux sensor 10 to output the detection signal for the developer amount detection. This configuration secures the time period to detect the amount of developer in the developer reservoir 90*a* and inhibits detection failure. Accordingly, the detection accuracy can be further enhanced than a case where a powder amount is detected by the pressure sensor or the like, and a state in which the amount of powder remaining in a powder reservoir is small can be detected with a high precision. In addition, the amount of powder supplied into the powder reservoir can be controlled with a high degree of accuracy, and overflow of powder is inhibited. Furthermore, even near the end of developer in the developer bottle 117 or during the recovery filling of the developer reservoir 90*a* immediately after replacement of the developer bottle 117, the shortage of developer in the developer reservoir 90*a* or an insufficient toner concentration in the developing device 112 can be prevented.

Embodiment 2

In Embodiment 1 described above, the first driving motor 131 drives the first and second stirring conveyors 96 and 97 and the first and second conveyors 98 and 99. By contrast, an electromagnetic clutch can be disposed therebetween such that the drive transmission to the first and second conveyors 98 and 99 is blocked.

Figure 30:
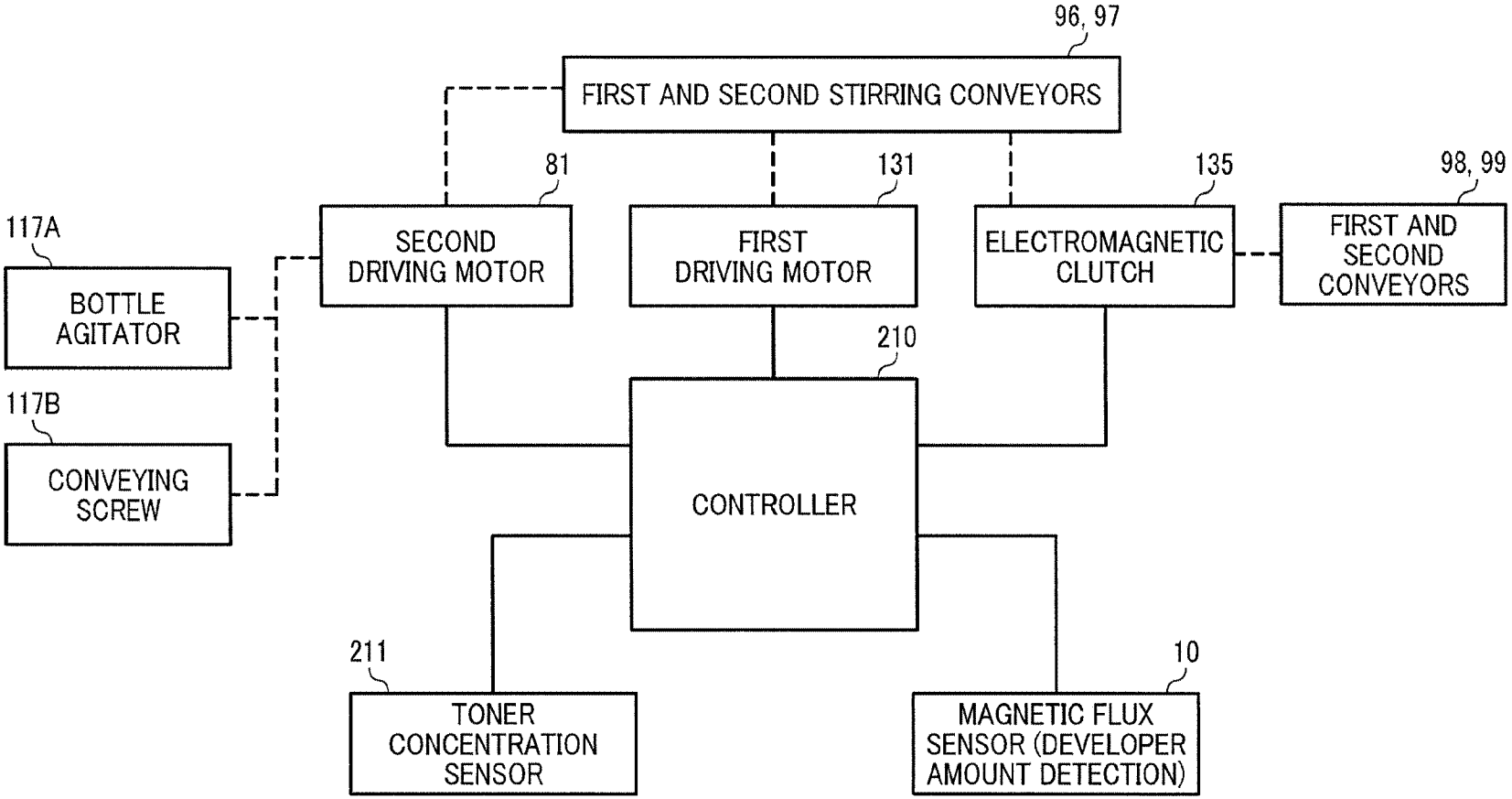
FIG. 30 is a block diagram illustrating an exemplary configuration of principal portions of control circuitry of a developer supply device according to Embodiment.
Figure 31:
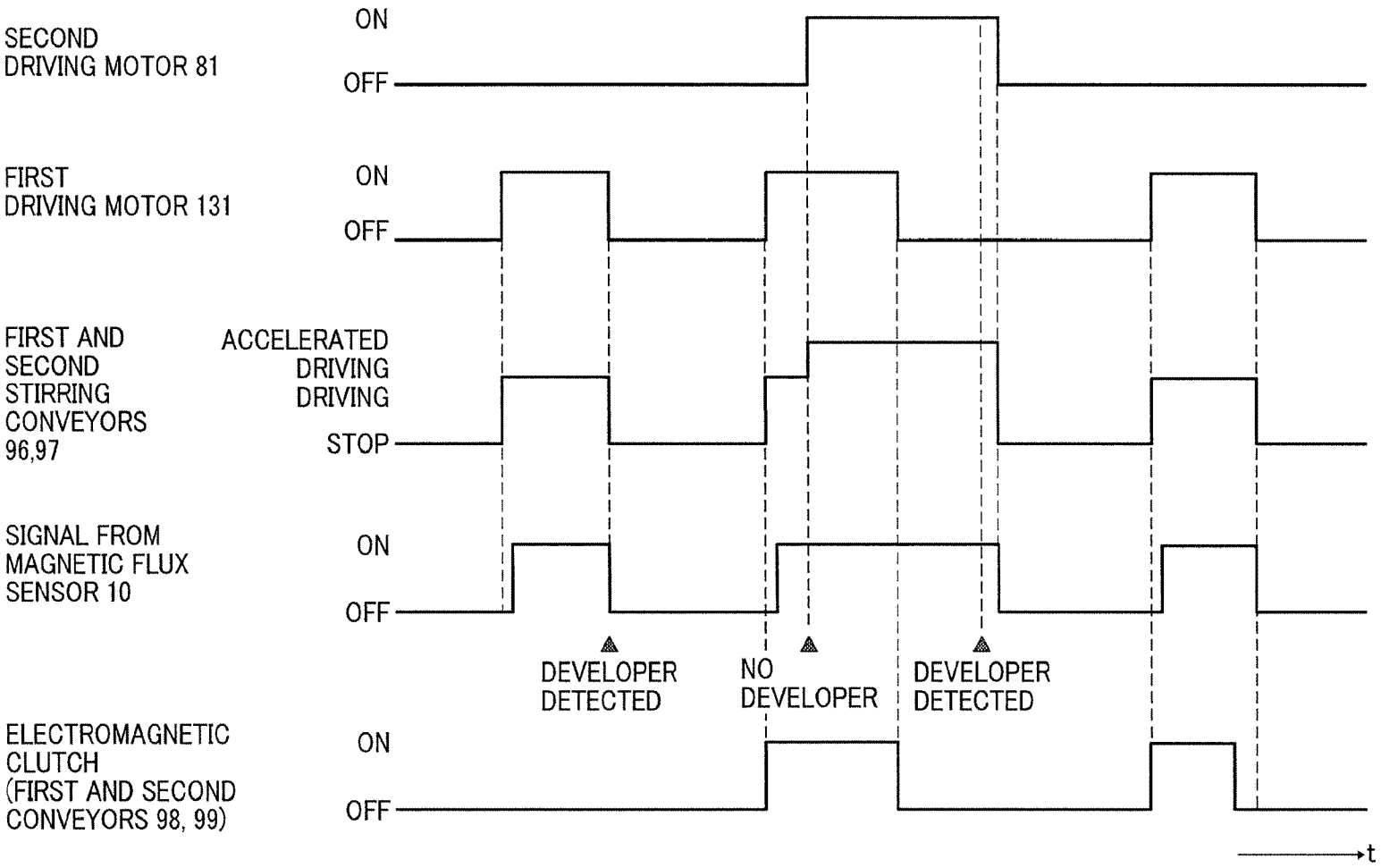
FIG. 31 is a timing chart illustrating an example of driving respective members in the developer supply device according to Embodiment 2.

FIG. 30 is a block diagram illustrating an exemplary configuration of principal portions of control circuitry of a developer supply device according to Embodiment 2. FIG. 31 is a timing chart illustrating driving of respective members in the developer supply device according to Embodiment 2. The drive control of an electromagnetic clutch 135 and the drive control of the first and second conveyors 98 and 99 are similar to each other and represented by a single timing chart in FIG. 31.

As illustrated in FIG. 30, the electromagnetic clutch 135 is connected to the controller 210. The electromagnetic clutch 135 is disposed where driving is transmitted from the first and second stirring conveyors 96 and 97 to the first and second conveyors 98 and 99. Accordingly, when the electromagnetic clutch 135 is turned on, the clutch is connected. Then, the driving force of the first driving motor 131 is transmitted to the first and second conveyors 98 and 99 via the first and second stirring conveyors 96 and 97. On the other hand, when the electromagnetic clutch 135 is turned off, the clutch is disconnected. Thus, the driving force is not transmitted to the first and second conveyors 98 and 99, while the first and second stirring conveyors 96 and 97 are driven by the first driving motor 131. The first and second conveyors 98 and 99 are driven when both of the first driving motor 131 and the electromagnetic clutch 135 are on.

In FIG. 31, in a case where the controller 210 attempts to obtain the detection signal from the magnetic flux sensor 10 to detect whether the developer is present in the developer reservoir 90*a* of the sub-hopper 90, the first driving motor 131 is turned on, and the first and second stirring conveyors 96 and 97 are driven. As the first stirring conveyor 96 drives, the magnetic flux sensor 10 outputs the detection signal. Based on the detection signal from the magnetic flux sensor 10, the controller 210 detects whether or not the developer is present in the developer reservoir 90*a*. Here, the electromagnetic clutch 135 is kept being off. Thus, the first and second conveyors 98 and 99 do not receive the driving force of the first driving motor 131 and are consequently not driven.

When the controller 210 detects that the developer is present in the developer reservoir 90*a*, the controller 210 turns off the first driving motor 131, thereby stopping the first and second stirring conveyors 96 and 97. Additionally, as the first stirring conveyor 96 is stopped, the magnetic flux sensor 10 stops outputting the detection signal.

Thereafter, when the developer in the developing device 112 becomes insufficient and additional developer is supplied thereto, the controller 210 turns the first driving motor 131 on, thereby driving the first and second stirring conveyors 96 and 97. Simultaneously, the electromagnetic clutch 135 is turned on such to transmit the driving force to the first and second conveyors 98 and 99 to drive these conveyors. Then, the developer is supplied to the developing device 112. Meanwhile, as the first stirring conveyor 96 drives, the magnetic flux sensor 10 outputs the detection signal. Based on the detection signal from the magnetic flux sensor 10, the controller 210 detects whether or not the developer is present in the developer reservoir 90*a*. Subsequently, detecting the detection signal from the magnetic flux sensor 10 indicating that there is no developer in the developer reservoir 90*a*, the controller 210 turns on the second driving motor 81. Consequently, the developer is supplied to the developer reservoir 90*a* from the developer bottle 117. At this time, the rotation speed of the first and second stirring conveyors 96 and 97 is accelerated with the driving force of the second driving motor 81, and stirring of the developer in the developer reservoir 90*a* is promoted.

Subsequently, once a sufficient amount of the developer is supplied to the developing device 112, the controller 210 turns off the electromagnetic clutch 135 to stop the first and second conveyors 98 and 99, thereby stopping supply of developer from the sub-hopper 90 (the developer reservoir 90*a*). At this time, although the first driving motor 131 is turned off simultaneously, the first and second stirring conveyors 96 and 97 are continuously driven by the second driving motor 81. Thereafter, detecting the detection signal from the magnetic flux sensor 10 indicating that the developer is present in the developer reservoir 90*a*, the controller 210 turns off the second driving motor 81 after a predetermined time period (e.g., one second) elapses. With this action, the first and second stirring conveyors 96 and 97 stop driving. Since the first stirring conveyor 96 is stopped, the magnetic flux sensor 10 stops outputting the detection signal. Later on, the controller 210 repeats the control operation described above.

According to Embodiment 2, the controller 210 can drive only the first and second stirring conveyors 96 and 97 by switching the electromagnetic clutch 135 and can obtain the detection signal from the magnetic flux sensor 10 by driving the first stirring conveyor 96. Therefore, regardless of the timing of developer supply to the developer reservoir 90*a* or the timing of developer supply to the developing device 112, the controller 210 can detect the amount of the developer (whether the developer is present) in the developer reservoir 90*a* at an appropriate timing. Consequently, a sufficient detection time period is secured, and the detection failure is inhibited.

Embodiment 3

In Embodiment 2 described above, the electromagnetic clutch 135 is disposed between the stirrers (the first and second stirring conveyors 96 and 97) to stir developer in the sub-hopper 90 and the developer conveys (the first and second conveyors 98 and 99) to supply developer from the sub-hopper 90. By contrast, separate driving motors can be employed to stir the developer in the sub-hopper 90 and to supply the developer from the sub-hopper 90, as in Embodiment 3.

Figure 32:
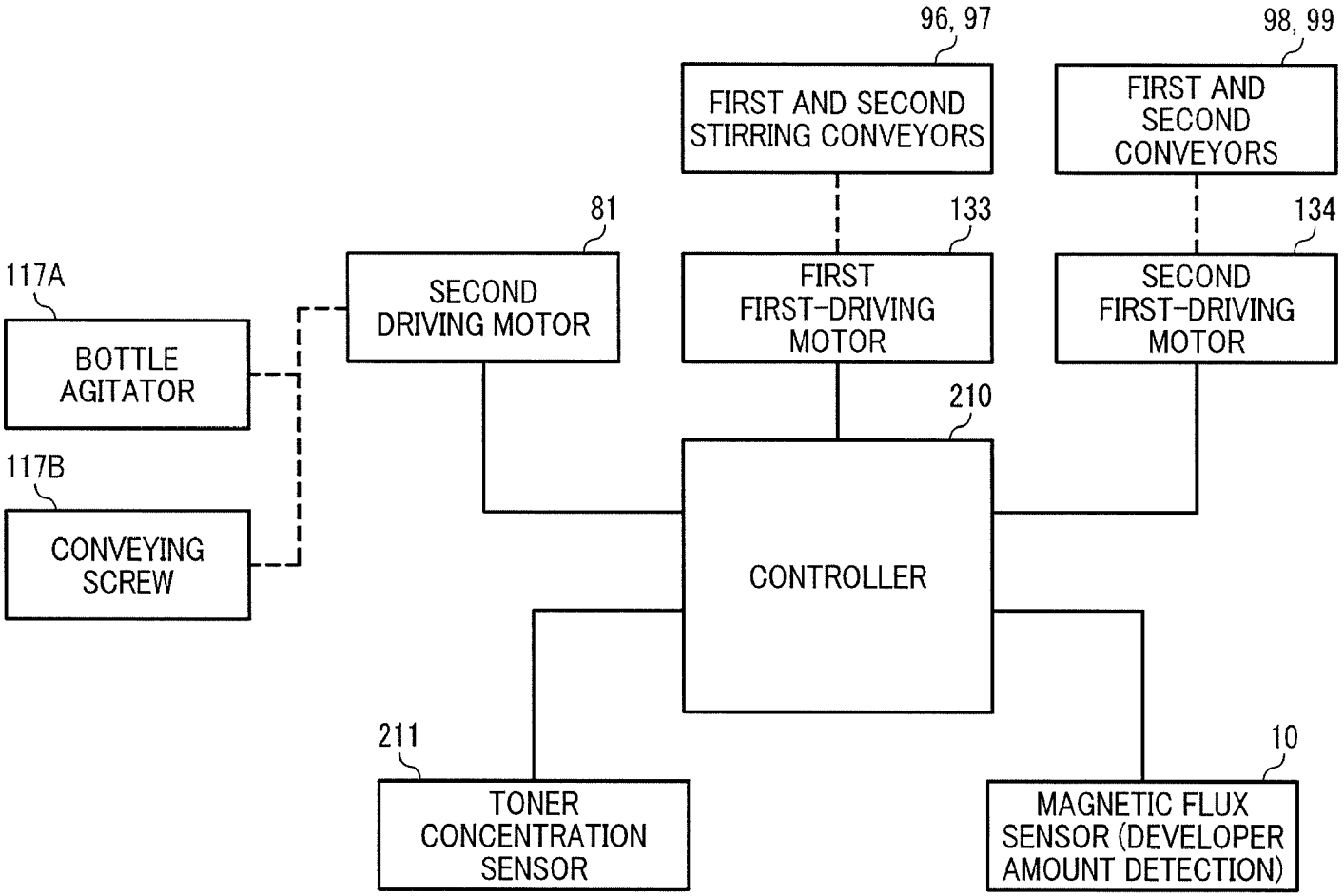
FIG. 32 is a block diagram illustrating an exemplary configuration of principal portions of control circuitry of a developer supply device according to Embodiment.

FIG. 32 is a block diagram illustrating an exemplary configuration of principal portions of control circuitry of a developer supply device according to Embodiment 3. FIG. is a timing chart illustrating driving of respective members in the developer supply device according to Embodiment 3. The drive control of the first first-driving motor 133 and that of the first and second stirring conveyors 96 and 97 are similar to each other and represented by a single timing chart in FIG. 33. Likewise, the drive control of the second first-driving motor 134 and that of the first and second conveyors 98 and 99 are similar to each other and represented by a single timing chart.

As illustrated in FIG. 32, the first first-driving motor 133, which drives the first and second stirring conveyors 96 and 97, and the second first-driving motor 134, which drives the first and second conveyors 98 and 99, are connected to the controller 210, respectively. The driving of the first and second stirring conveyors 96 and 97 and the driving of the first and second conveyors 98 and 99 are separated from each other, and the first and second stirring conveyors 96 and 97 are driven independently of the first and second conveyors 98 and 99. In addition, the driving of the first and second stirring conveyors 96 and 97 is separate from the driving of the second driving motor 81 (to supply developer from the developer bottle 117 to the sub-hopper 90). Thus, the members to stir the developer in the sub-hopper 90 are driven independently of the second driving motor 81.

Figure 33:
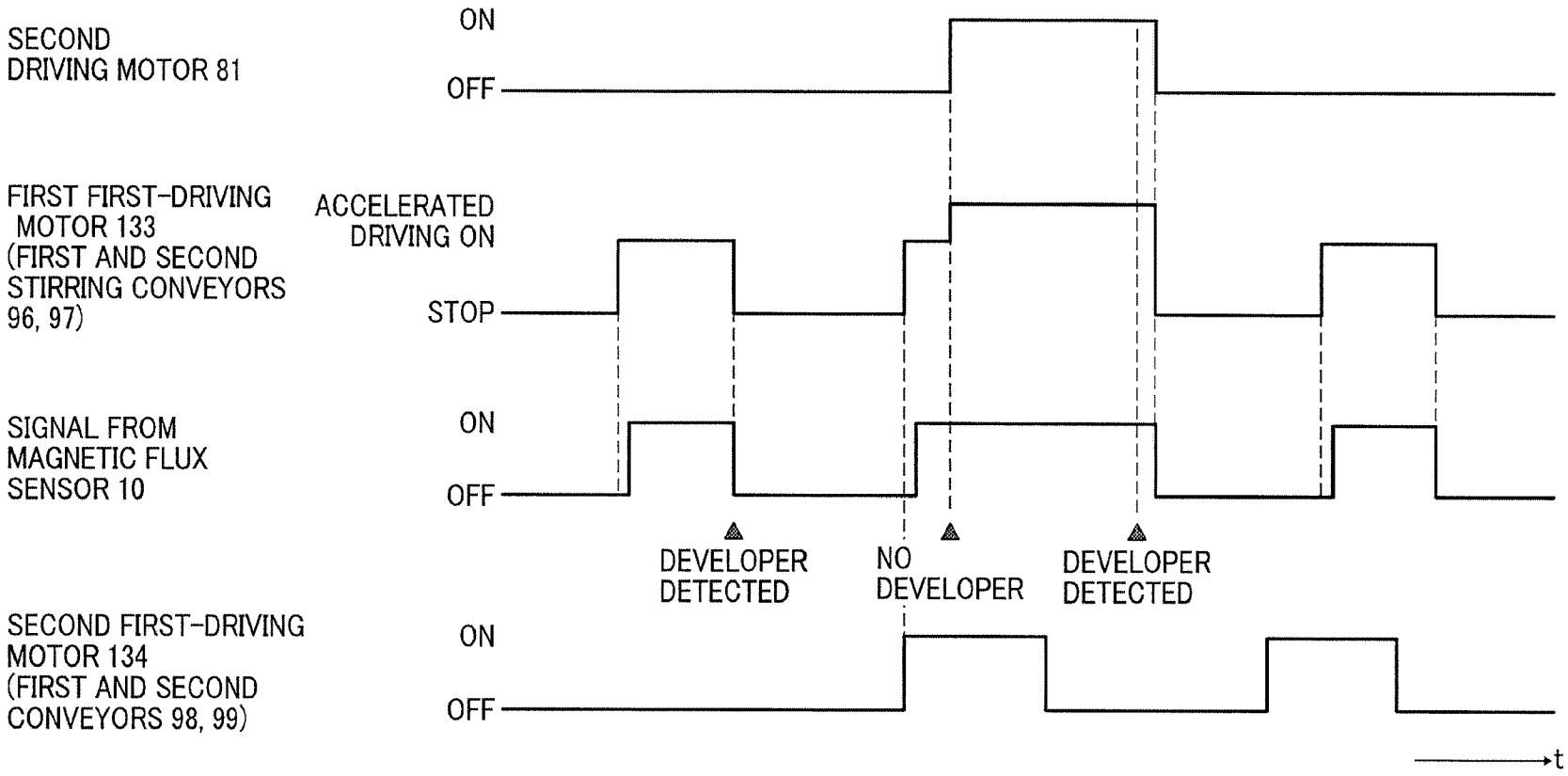
FIG. 33 is a timing chart illustrating an example of driving respective members in the developer supply device according to Embodiment 3.

In FIG. 33, in a case where the controller 210 attempts to obtain the detection signal from the magnetic flux sensor 10 to detect whether the developer is present in the developer reservoir 90*a*, the first first-driving motor 133 is turned on. Then, the first and second stirring conveyors 96 and 97 are driven simultaneously. As the first stirring conveyor 96 is driven, the magnetic flux sensor 10 outputs the detection signal with a slight delay after the first first-driving motor 133 is turned on. Based on the detection signal from the magnetic flux sensor 10, the controller 210 detects whether or not the developer is present in the developer reservoir 90*a*.

Subsequently, detecting that the developer is present in the developer reservoir 90*a*, the controller 210 turns off the first first-driving motor 133, thereby simultaneously stopping the driving of the first and second stirring conveyors 96 and 97. Additionally, as the first stirring conveyor 96 is stopped, the magnetic flux sensor 10 stops outputting the detection signal.

Thereafter, when the developer in the developing device 112 becomes insufficient and additional developer is supplied thereto, the controller 210 turns on the second first-driving motor 134, thereby driving the first and second conveyors 98 and 99 to supply the developer to the developing device 112. At this time, the first first-driving motor 133 is simultaneously turned on to drive the first and second stirring conveyors 96 and 97. As the first stirring conveyor 96 drives, the magnetic flux sensor 10 outputs the detection signal. Subsequently, detecting the detection signal from the magnetic flux sensor 10 indicating that there is no developer in the developer reservoir 90*a*, the controller 210 turns on the second driving motor 81. Consequently, the developer is supplied to the developer reservoir 90*a* from the developer bottle 117. At this time, the rotation speed of the first first-driving motor 133 is accelerated. As a result, the rotation speed of the first and second stirring conveyors 96 and 97 is accelerated to promote stirring of the developer in the developer reservoir 90*a*.

Subsequently, once a sufficient amount of the developer is supplied to the developing device 112, the controller 210 turns off the second first-driving motor 134, thereby stopping developer supply by the first and second conveyors 98 and 99. The first and second conveyors 98 and 99 stop driving since the second first-driving motor 134 has stopped. The first and second stirring conveyors 96 and 97, however, are continuously driven by the first first-driving motor 133. Thereafter, detecting the detection signal from the magnetic flux sensor 10 indicating that the developer is present in the developer reservoir 90*a*, the controller 210 turns off the second driving motor 81 after a predetermined time period (e.g., one second) elapses. In addition, the first first-driving motor 133 is simultaneously turned off to stop the driving of the first and second stirring conveyors 96 and 97. Since the first stirring conveyor 96 is stopped, the magnetic flux sensor 10 stops outputting the detection signal. Later on, the controller 210 repeats the control operation described above.

According to Embodiment 3, the controller 210 can drive, with the first first-driving motor 133, only the first and second stirring conveyors 96 and 97 to obtain the detection signal from the magnetic flux sensor 10, which accompanies the driving of the first stirring conveyor 96. Therefore, regardless of the timing of developer supply to the developer reservoir 90*a* or the timing of developer supply to the developing device 112, the controller 210 can detect the amount of the developer (whether the developer is present) in the developer reservoir 90*a* at an appropriate timing. Consequently, a sufficient detection time period is secured, and the detection failure is inhibited.

Alternatively, in the aforementioned embodiments, the developer amount detector to detect the amount of developer in the sub-hopper can use displacement of a detected member. Such a configuration includes a detected member (e.g., a sheet to be pressed) disposed to move in the sub-hopper, a contact member, e.g., a stirring sheet) to make the detected member to move, and a detector to detect displacement of the detected member. The contact member is disposed on the rotation shaft of a rotator that is rotated in the sub-hopper and to contact and move the detected member while rotating together with the rotation shaft.

The various aspects of the present specification can attain specific effects as follows.

Aspect A

A powder supply device such as the developer supply device includes: a downstream powder container such as the developer reservoir 90*a* of the sub-hopper 90 to temporarily store powder supplied from an upstream powder container such as the developer bottle 117 accommodating the powder such as the developer and then discharge the temporarily stored powder toward a supply destination such as the developing device 112; and a powder amount detector to detect an amount of the powder in the downstream powder container. The powder supply device is configured to supply the powder from the upstream powder container to the downstream powder container based on a detection result generated by the powder amount detector. The powder amount detector includes: a detected member, such as the vibration plate 201, disposed in the downstream powder container so as to vibrate or move; a contact member, such as the torsion spring 203, disposed on the rotation shaft 96*c* of a rotator, such as the first stirring conveyor 96, to rotate in the downstream powder container. While rotating together with the rotation shaft 96*c*, the contact member contacts the detected member to cause the detected member to vibrate or be displaced. The powder amount detector further includes a detector, such as the magnetic flux sensor 10, to detect a vibration state or a displacement state of the detected member; and a detection result processor, such as the controller 20, to detect the amount of the powder in the downstream powder container based on a detection result by the detector. The powder supply device further includes a controller such as the controller 210 to cause the rotator to rotate when the powder is discharged from the downstream powder container to the supply destination and when the powder is supplied from the upstream powder container to the downstream powder container.

According to this aspect, as described above, when the powder is discharged from the downstream powder container and when the powder is supplied to the downstream powder container, the rotator including the rotation shaft 96*c* provided with the contact member is rotated. Consequently, the detected member is caused to vibrate or displaced by the contact member. The detector detects vibration or displacement of the detected member, and the detection result processor can detect the amount of the powder in the downstream powder container based on a detection result generated by the detector. As described above, at both of a timing of discharging the powder from the downstream powder container and a timing of supplying the powder to the downstream powder container, at which the amount of the developer in the downstream powder container is expected to change, the amount of the powder in the downstream powder container can be reliably detected. In particular, even in a case where the powder is supplied from the upstream powder container to the downstream powder container prior to discharging the powder from the downstream powder container, the amount of the powder in the downstream powder container can be reliably detected.

Besides, the detected member, which contacts the powder in the downstream powder container, vibrates or is displaced when touched by the contact member rotating together with the rotator. Consequently, the powder is unlikely to adhere to the detected member. Therefore, an influence of the powder adhesion is unlikely to occur on the vibration state or the displacement state of the detected member, which is used to detect the amount of the powder and thus, erroneous detection of the amount of powder due to the powder adhesion is unlikely to occur.

Aspect B

In the aforementioned aspect A, the powder supply device further includes a stirrer such as the first stirring conveyor 96 to stir the powder in the downstream powder container, and the stirrer serves as the rotator having the rotation shaft 96*c* to which the contact member, such as the torsion spring 203, is attached.

According to this aspect, as described above, the stirrer of the downstream powder container is rotated when the powder is discharged from the downstream powder container and when the powder is supplied to the downstream powder container. Consequently, while the powder in the downstream powder container is stirred, the detection result processor can detect the amount of the powder in the downstream powder container.

Aspect C

In the aforementioned aspect B, the powder supply device further includes: a powder conveyor, such as the first conveyor 98, to convey the powder from the downstream powder container to the supply destination; an powder supply member, such as the second bottle agitator 117A (or the conveying screw 117B) of the developer bottle 117, to supply the powder from the upstream powder container to the downstream powder container through a supply opening; a first driving source, such as the first driving motor 131, to drive the stirrer of the downstream powder container and the powder conveyor; and a second driving source, such as the second driving motor 81, to drive the powder supply member and the stirrer. The first driving source drives the stirrer of the downstream powder container and the powder conveyor when the powder is discharged from the downstream powder container to the supply destination. Meanwhile, the second driving source drives the powder supply member and the stirrer of the downstream powder container when the powder is supplied from the upstream powder container to the downstream powder container.

According to this aspect, as described above, the stirrer, to which the detected member used in powder amount detection is driven by both of the first driving source and the second driving source. Therefore, the powder amount detector can reliably detect the amount of the powder in the downstream powder container when the powder is discharged from the downstream powder container to the supply destination and when the powder is supplied from the upstream powder container to the downstream powder container.

Aspect D

In the aforementioned aspect C, drive transmission from the first driving source to the stirrer of the downstream powder container and drive transmission from the second driving source to the stirrer are respectively carried out by way of first and second one-way clutches, such as the one-way clutch 132 (first-driving side) and the one-way clutch 82 (second-driving side), and a rotation speed of the stirrer being driven by the first driving source is made different from a rotation speed of the stirrer being driven by the second driving source.

According to this aspect, as described above, the driving of the stirrer by the first driving source and the driving of the stirrer by the second driving source can be switched to each other with ease by using inexpensive one-way clutches. In addition, in a case where the first driving source and the second driving source are simultaneously driven, the stirrer can be driven by the faster of the first driving source and the second driving source.

Aspect E

In the aforementioned aspect D, the rotation speed of the stirrer being driven by the second driving source is faster than the rotation speed of the stirrer being driven by the first driving source.

According to this aspect, as described above, the stirrer rotates at a higher speed in a case where the powder is supplied from the upstream powder container to the downstream powder container than a case where the powder is discharged from the downstream powder container to the supply destination. Accordingly, stirring of the powder in the downstream powder container is promoted during powder supply.

Aspect F

In any one of the aforementioned aspects C to E, the second driving source drives the stirrer constantly at least while the powder supply device is operating.

According to this aspect, as described above, the stirrer is constantly driven while the powder supply device is operating, and, in the meantime, the amount of the powder in the downstream powder container is detected by the powder amount detector. Therefore, the powder amount detector can detect the amount of the powder in the downstream powder container at an arbitrary timing while the powder supply device is operating.

Aspect G

In any one of the aforementioned aspects C to F, the powder supply device further includes an electromagnetic clutch (e.g., the electromagnetic clutch 135), and the driving force of the first driving source is transmitted from the stirrer to the powder conveyor via the electromagnetic clutch.

According to this aspect, as described above, when the electromagnetic clutch is turned off to block the drive transmission to the powder conveyor, the first driving source can drive the stirrer only. Therefore, regardless of a timing of discharging the powder from the downstream powder container to the supply destination or a timing of supplying the powder from the upstream powder container to the downstream powder container, the amount of the powder in the downstream powder container can be detected at an arbitrary timing, similar to a configuration using a piezoelectric sensor.

Aspect H

In any one of Aspects A through D, the contact member includes an elastic body, such as the torsion spring 203, being constantly biased to one side in the rotation direction of the rotation shaft.

With this aspect, as described above, the elastic body exerts a resilience to cause the contact member to quickly pass the area opposed to the vibration plate. Accordingly, the vibration of the vibration plate is not hindered.

Aspect I

In the aforementioned aspect H, the torsion spring 203 is used as the elastic body.

With this aspect, as described above, the torsion spring exerts a spring resilience to quickly pass the area opposed to the vibration plate, and the vibration of the vibration plate is not hindered. Further, the durability of the contact member is enhanced.

Aspect J

An image forming apparatus such as the image forming apparatus 100 includes an image bearer (e.g., the photoconductor drum 109), a developing device (e.g., the developing device 112), and the powder supply device according to Aspect I, to supply the developer to the developing device as the supply destination.

According to this aspect, as described above, the amount of the developer in the downstream powder container can be detected at both of when the developer is discharged from the downstream powder container and when the developer is supplied to the downstream powder container. Additionally, erroneous detection of developer amount due to developer adhesion is unlikely to occur.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A powder supply device, comprising:

a case;

a powder reservoir within the case, the powder reservoir including a rotator having a rotation shaft, the powder reservoir to store powder supplied from a powder container;

a detected member within the case, the detected member to vibrate;

a torsion spring including an elastic body, the torsion spring being adjacent to and contacting the rotation shaft, the torsion spring being biased in a rotation direction of the rotation shaft so that the torsion spring rotates together with the rotation shaft, and the torsion spring contacting the detected member to adjust a vibration of the detected member;

a magnetic flux sensor outside of the case, the magnetic flux sensor to detect the vibration of the detected member through the case; and a detection result processor to detect the amount of the powder in the powder reservoir based on a detection result of the magnetic flux sensor; and a controller to, based on the detection result, control the rotator to rotate with a rotation speed while the powder is supplied from the powder container to the powder reservoir, and rotate to discharge the powder from the powder reservoir to a supply destination.

2. The powder supply device according to claim 1, wherein the rotator is a stirrer disposed in the powder reservoir to stir the powder in the powder reservoir.

3. The powder supply device according to claim 2, further comprising:

a powder conveyor disposed in the powder reservoir to convey the powder from the powder reservoir to the supply destination;

a powder supply member disposed in the powder container to supply the powder from the powder container to the powder reservoir;

a first driving source to drive the stirrer of the powder reservoir and the powder conveyor; and a second driving source to drive the powder supply member and the stirrer of the powder reservoir, wherein the first driving source drives the stirrer of the powder reservoir and the powder conveyor in discharging the powder from the powder reservoir to the supply destination, and the second driving source drives the powder supply member and the stirrer of the powder reservoir in supplying the powder from the powder container to the powder reservoir.

4. The powder supply device according to claim 3, further comprising:

a first one-way clutch disposed between the first driving source and the stirrer, the first one-way clutch via which a driving force from the first driving source is transmitted to the rotation shaft; and a second one-way clutch disposed between the second driving source and the stirrer, wherein a rotation speed of the stirrer being driven by the first driving source is different from a rotation speed of the stirrer being driven by the second driving source.

5. The powder supply device according to claim 4, wherein the rotation speed of the stirrer being driven by the second driving source is faster than the rotation speed of the stirrer being driven by the first driving source.

6. The powder supply device according to claim 3, wherein the controller causes the second driving source to drive the stirrer at least while the powder supply device is discharging the powder from the powder container to the powder reservoir.

7. The powder supply device according to claim 6, wherein the controller causes the second driving source to drive the stirrer constantly at least while the powder supply device is discharging the powder from the powder container to the powder reservoir.

8. The powder supply device according to claim 3, further comprising:

an electromagnetic clutch disposed between the stirrer and the powder conveyor, wherein a driving force of the first driving source is transmitted from the stirrer to the powder conveyor via the electromagnetic clutch.

9. The powder supply device according to claim 1, wherein the magnetic flux sensor outputs a counting signal to the detection result processor, and the detection result processor detects the amount of powder in the powder reservoir based on the counting signal.

10. The powder supply device according to claim 9, wherein the detected member is a vibration plate, and the magnetic flux sensor is disposed to face the vibration plate.

11. The powder supply device according to claim 10, wherein the detected member is flipped by the torsion spring, and the magnetic flux sensor detects the amount of powder in the powder reservoir based on an attenuation of the detected member.

12. The powder supply device according to claim 1, wherein the detected member is a vibration plate.

13. The powder supply device according to claim 1, further comprising:

a second rotator disposed in the powder reservoir, wherein the rotator is a first stirrer and the second rotator is a second stirrer, the first stirrer and the second stirrer stir the powder in the powder reservoir, and the controller controls the first stirrer and the second stirrer to rotate with the rotation speed that is accelerated while the powder is supplied from the powder container to the powder reservoir.

14. An image forming apparatus, comprising:

an image bearer;

a latent image forming device to form a latent image on the image bearer;

a developing device to develop, with developer, the latent image on the image bearer; and a powder supply device comprising:

a case;

a powder reservoir within the case, the powder reservoir including a rotator having a rotation shaft, the powder reservoir to temporarily store the developer supplied from a powder container;

a detected member within the case, the detected member to vibrate;

a torsion spring including an elastic body, the torsion spring being adjacent to and contacting the rotation shaft, the torsion spring being biased in a rotation direction of the rotation shaft so that the torsion spring rotates together with the rotation shaft, and the torsion spring contacting the detected member to adjust a vibration of the detected member;

a magnetic flux sensor outside of the case, the magnetic flux sensor to detect the vibration of the detected member through the case; and a detection result processor to detect the amount of the developer in the powder reservoir based on a detection result of the magnetic flux sensor; and a controller to, based on the detection result, control the rotator to rotate with a rotation speed while the developer is supplied from the powder container to the powder reservoir, and rotate to discharge the developer from the powder reservoir to the developing device.

15. The image forming apparatus according to claim 14, wherein the magnetic flux sensor outputs a counting signal to the detection result processor, and the detection result processor detects the amount of the developer in the powder reservoir based on the counting signal.

16. The image forming apparatus according to claim 15, wherein the detected member is a vibration plate, and the magnetic flux sensor is disposed to face the vibration plate.

17. The image forming apparatus according to claim 15, wherein the detected member is flipped by the torsion spring, and the magnetic flux sensor detects the amount of power in the powder reservoir based on an attenuation of the detected member.

18. The image forming apparatus according to claim 14, wherein the detected member is a vibration plate.

* * * * *